US010069239B2

(12) United States Patent
Avital

(10) Patent No.: US 10,069,239 B2
(45) Date of Patent: Sep. 4, 2018

(54) CONNECTOR FOR ELECTRICALLY CONNECTING SETS OF CONDUCTING WIRES

(71) Applicant: Elad Avital, Givat Shmuel (IL)

(72) Inventor: Elad Avital, Givat Shmuel (IL)

( * ) Notice: Subject to any disclaimer, the term of this patent is extended or adjusted under 35 U.S.C. 154(b) by 0 days.

(21) Appl. No.: 14/926,959

(22) Filed: Oct. 29, 2015

(65) Prior Publication Data

US 2016/0049749 A1 Feb. 18, 2016

Related U.S. Application Data

(63) Continuation-in-part of application No. PCT/IL2014/000020, filed on Apr. 13, 2014.

(60) Provisional application No. 61/817,520, filed on Apr. 30, 2013.

(51) Int. Cl.

| | |
|---|---|
| ***H01R 13/58*** | (2006.01) |
| ***H01R 4/48*** | (2006.01) |
| ***H01R 43/16*** | (2006.01) |
| *H01R 105/00* | (2006.01) |
| *H01R 4/50* | (2006.01) |
| *H01R 11/09* | (2006.01) |

(52) U.S. Cl.

CPC ..... *H01R 13/58* (2013.01); *H01R 4/48* (2013.01); *H01R 4/489* (2013.01); *H01R 4/4836* (2013.01); *H01R 43/16* (2013.01); *H01R 4/5025* (2013.01); *H01R 11/09* (2013.01); *H01R 2105/00* (2013.01)

(58) Field of Classification Search

CPC ..... H01R 13/622; H01R 2103/00; H01R 4/2433; H01R 13/5812; H01R 13/59; H01R 4/5025

USPC ..... 439/320, 322, 323, 417, 454, 460, 461, 439/462, 784

See application file for complete search history.

(56) References Cited

U.S. PATENT DOCUMENTS

| | | | | |
|---|---|---|---|---|
| 2,546,395 A | | 3/1951 | Hubbard | |
| 3,654,588 A | | 4/1972 | Ruth | |
| 3,982,319 A | * | 9/1976 | Bice | H01R 4/2408 174/71 R |
| 4,060,299 A | * | 11/1977 | Williams | H01R 13/746 439/289 |
| 4,629,274 A | | 12/1986 | Pollock | |
| 4,643,513 A | | 2/1987 | Martin | |

(Continued)

FOREIGN PATENT DOCUMENTS

WO 2014/178041 11/2014

OTHER PUBLICATIONS

An International Search Report and a Written Opinion both dated Nov. 13, 2014, which issued during the prosecution of Applicant's PCT/IL2014/000020.

(Continued)

*Primary Examiner* — Thanh Tam Le

(57) ABSTRACT

A coupler optionally couples two sets of conductive wires. In some embodiments, the coupler includes a body having a first end with a first set of at least two holes and a second end with a second set of two holes. Optionally each hole includes a clamp. Optionally, each clamp of said first set of holes is conductively connected to at least one clamp of said second set of holes. In some embodiments a first rotating element simultaneous attaches to said coupler a first set of a plurality of wires inserted into said first set of holes and/or a second rotating element simultaneous attaches to said coupler a second set of a plurality of wires inserted into said second set of holes.

18 Claims, 23 Drawing Sheets

(56) References Cited

U.S. PATENT DOCUMENTS 5,299,951 A * 4/1994 Blaetz ..... H01R 13/5208 439/367
5,989,056 A * 11/1999 Lange ..... H01R 4/2433 439/412
6,443,756 B1 9/2002 Hagmann et al.
6,830,491 B1 * 12/2004 Tomasino ..... H01R 4/5033 439/322
7,014,513 B2 * 3/2006 Tomasino ..... H01R 13/5202 439/274
7,097,486 B2 * 8/2006 Parsons ..... H01R 13/5202 439/291
7,467,978 B2 * 12/2008 Sundermeier ..... H01R 9/031 439/320
7,824,204 B2 * 11/2010 Fujiwara ..... H01R 13/5219 439/311
7,976,070 B2 * 7/2011 Kiely ..... F16L 19/061 174/652
8,500,497 B1 * 8/2013 Patten ..... H01R 4/5091 439/784
8,790,128 B2 * 7/2014 Andresen ..... H01R 4/2433 439/320
8,986,038 B2 * 3/2015 Franke ..... H01R 4/30 439/359
2011/0318975 A1 12/2011 Giefers et al.

OTHER PUBLICATIONS

An International Preliminary Report on Patentability dated Nov. 3, 2015, which issued during the prosecution of Applicant's PCT/IL2014/000020.
U.S. Appl. No. 61/817,520, filed Apr. 30, 2013.

* cited by examiner

CONNECTOR FOR ELECTRICALLY CONNECTING SETS OF CONDUCTING WIRES

REFERENCE TO RELATED APPLICATIONS

This application is a Continuation-in-Part of International Application PCT/IL2014/000020, entitled ELECTRICAL CONNECTING DEVICE, with an international filing date of Apr. 13, 2014, which International Application PCT/IL2014/000020 claims the benefit of U.S. Provisional Patent Application 61/817,520, filed Apr. 30, 2013, the disclosures of which are hereby incorporated by reference and priorities of which are hereby claimed pursuant to 37 CFR 1.78(a)(4) and (5)(i).

FIELD OF THE INVENTION

The present invention relates generally to connector devices and particularly to electrical connector devices.

BACKGROUND OF THE INVENTION

Various types of electrical connector devices are known in the art.

SUMMARY OF THE INVENTION

The present invention seeks to provide novel devices and methods for fastening and electrically connecting wires.

There is thus provided in accordance with a preferred embodiment of the present invention a connector device including a device body having a first end and a second end, a first plurality of slots formed in the device body, the first plurality of slots having a second plurality of openings formed at the first end of the device body and a third plurality of openings formed at the second end of the device body, the second plurality of openings being adapted for insertion of a first set of conductive wires therein, the third plurality of openings being adapted for insertion of a second set of conductive wires therein, a multiplicity of conductive clamping elements disposed in the first plurality of slots, the multiplicity of clamping elements including a first clamping spring disposed within each of the second plurality of openings for clamping the first set of conductive wires therein and a second clamping spring disposed within each of the third plurality of openings for clamping the second set of conductive wires therein, a first fastening ring rotatable over the first end of the device body for simultaneously rotationally fastening the first set of conductive wires in the second plurality of openings and a second fastening ring rotatable over the second end of the device body for simultaneously rotationally fastening the second set of conductive wires in the third plurality of openings, the first and second sets of conductive wires being mutually electrically connected when so fastened.

In accordance with a preferred embodiment of the present invention, each conductive wire includes a conductive core and an insulative sheath, the fastening including gripping of the insulative sheath.

Preferably, the gripping of the insulative sheath provides stress relief on the conductive wire.

Preferably, each clamping element includes a pair of the first and second clamping springs mutually connected by a conductive bridge.

Preferably, each clamping spring is operatively coupled to a depressible tab located on an exterior surface of the device body.

Preferably, each clamping spring includes an acutely angled elongate section lying in a first plane and extending upwards from the conductive bridge, an upper widened flat lip contiguous with the acutely angled elongate section, the lip extending outwards from the first plane so as to terminate in a second plane, a perpendicularly bent leg emerging from the lip, the perpendicularly bent leg having an orthogonally angled foot extending generally perpendicular to the first plane and a slanted section extending upwards from the foot and lying in the second plane, the slanted section being at least partially coplanar with the widened flat lip, the slanted section terminating at a folded end section, the folded end section being capped by the depressible tab.

Preferably, a gap is defined between the lip and the slanted section, the gap being widened so as to permit insertion of the conductive wire therein upon depression of the depressible tab.

In accordance with a preferred embodiment of the present invention, the device body includes a unitary element when in use.

Additionally or alternatively, the device body includes two interlocking elements.

Additionally or alternatively, the device body includes a multi junction element for mutually connecting more than two sets of conductive wires.

There is further provided in accordance with a preferred embodiment of the present invention a method for electrically connecting conductive wires including providing a device body having a first end and a second end, inserting a first set of conductive wires in a first plurality of openings of a second plurality of slots in the device body, inserting a second set of conductive wires in a third plurality of openings of the second plurality of slots, disposing a multiplicity of conductive clamping elements in the second plurality of slots, the multiplicity of clamping elements including a first clamping spring disposed within each of the first plurality of openings for clamping the first set of conductive wires therein and a second clamping spring disposed within each of the third plurality of openings for clamping the second set of conductive wires therein, rotationally fastening the first set of conductive wires simultaneously in the first plurality of openings and rotationally fastening the second set of conductive wires simultaneously in the third plurality of openings, the first and second sets of conductive wires being mutually electrically connected when so fastened.

In accordance with a preferred embodiment of the present invention, each conductive wire includes a conductive core and an insulative sheath, the fastening including gripping of the insulative sheath.

Preferably, the gripping of the insulative sheath provides stress relief on the conductive wire.

Preferably, each clamping element includes a pair of the first and second clamping springs mutually connected by a conductive bridge.

Preferably, each clamping spring is operatively coupled to a depressible tab located on an exterior surface of the device body.

Preferably, each clamping spring includes an acutely angled elongate section lying in a first plane and extending upwards from the conductive bridge, an upper widened flat lip contiguous with the acutely angled elongate section, the lip extending outwards from the first plane so as to terminate in a second plane, a perpendicularly bent leg emerging from the lip, the perpendicularly bent leg having an orthogonally angled foot extending generally perpendicular to the first plane and a slanted section extending upwards from the foot and lying in the second plane, the slanted section being at least partially coplanar with the widened flat lip, the slanted section terminating at a folded end section, the folded end section being capped by the depressible tab.

Preferably, a gap is defined between the lip and the slanted section, the gap being widened so as to permit insertion of the conductive wire therein upon depression of the depressible tab.

Preferably, the device body includes a unitary element when in use.

Additionally or alternatively, the device body includes two interlocking elements.

Additionally or alternatively, the device body includes a multi junction element for mutually connecting more than two sets of conductive wires.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
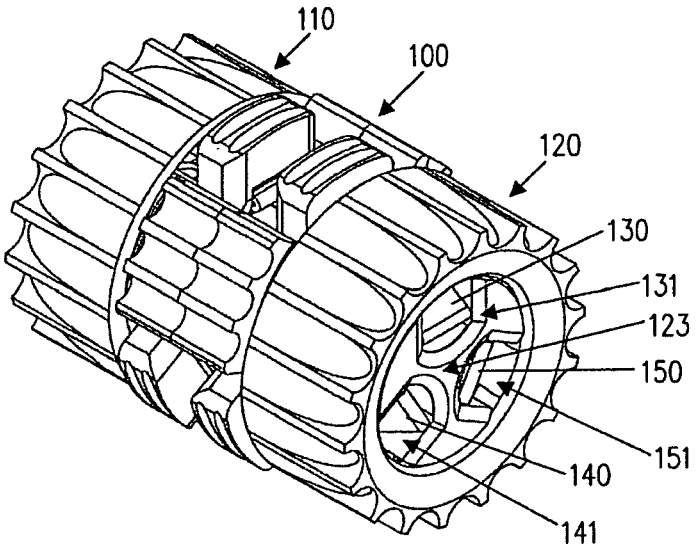
FIGS. 1A and 1B are simplified schematic respective perspective and top view illustrations of an electrical connector device, constructed and operative in accordance with a preferred embodiment of the present invention.
Figure 1B:
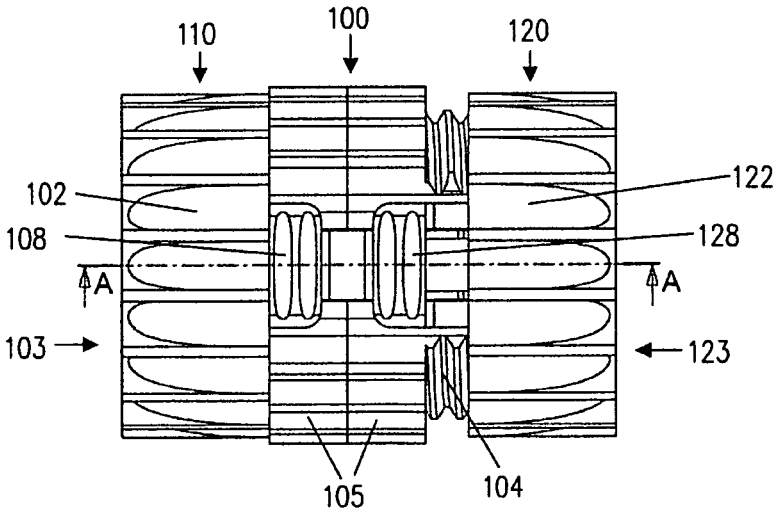

Reference is made to FIGS. 1A and 1B, which schematically illustrate an isometric view and a top view, respectively, of an electrical connecting device 100 according to exemplary embodiments of the invention.

According to exemplary embodiments of the invention, device 100 may include a first locking mechanism 110, and a second locking mechanism 120, each able to be in a "locked" state or in an "unlocked" state, as described in detail below. For example, mechanisms 110 and 120 as are shown in illustration 1B in the locked state and unlocked state, respectively.

According to exemplary embodiments of the invention, the locking mechanism may include at least one clamping device and a locking ring, as described below. For example, mechanism 110 may include a first tab 107 (not shown), a second tab 108, a third tab 109 (not shown) and a locking ring 102, and mechanism 120 may include a first tab 127 (not shown), a second tab 128, a third tab 129 (not shown) and a locking ring 122. At least part of an outer surface 104 of device 100 may be threaded, such that ring 102 and/or ring 122 may be fastened or released in relation to surface 104. For example, ring 122 may be fastened, e.g., by moving ring 122 away from a top end 123 of device 100, or released e.g., by moving ring 122 toward end 123, and ring 102 may be fastened, e.g., by moving ring 102 away from a top end 103 of device 100, or released e.g., by moving ring 122 toward end 103.

According to exemplary embodiments of the invention, a body 105 of device 100, tabs 107, 108, 109, 127, 128, and/or 129, and/or rings 102 and/or 122, may be formed of any suitable non-conductive, e.g., rigid material, for example any suitable plastic material as is known in the art with desired insulation and durability properties.

Figure 1C:
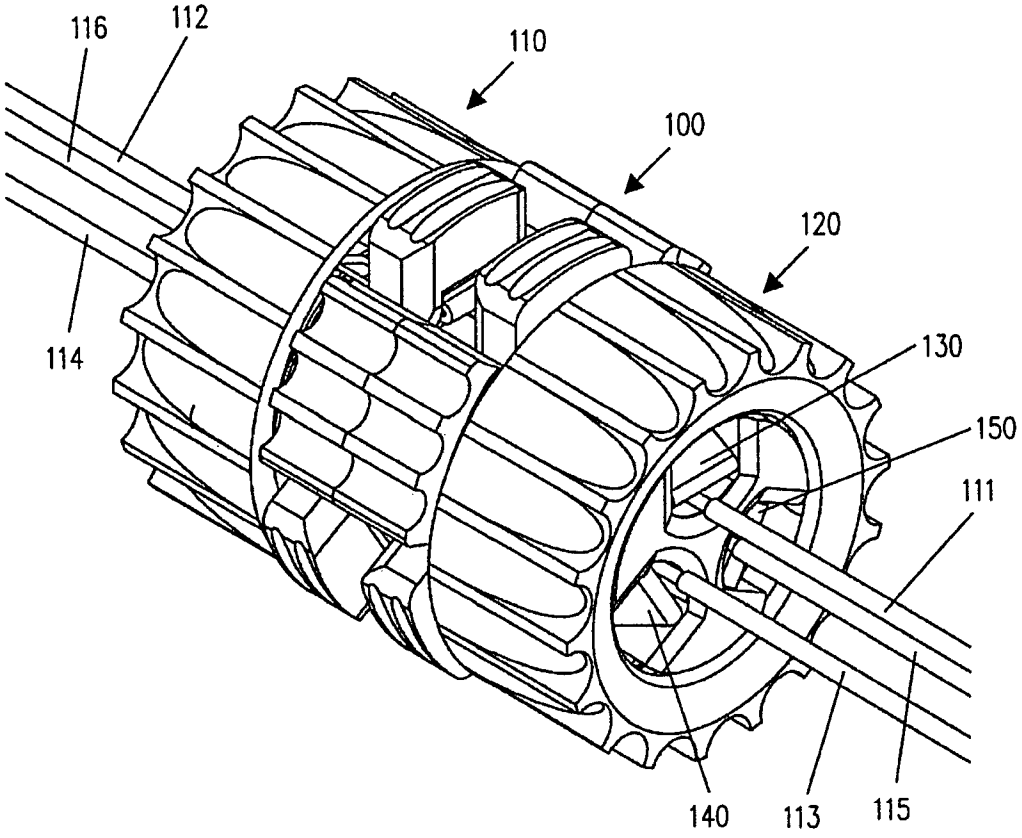
FIG. 1C is a simplified schematic perspective view illustration of an electrical connector device of a type shown in FIGS. 1A and 1B, having wires inserted therein.

Reference is also made to FIG. 1C, which schematically illustrate isometric view of the device of FIG. 1A.

According to exemplary embodiments of the invention, device 100 may include a first connecting mechanism 130 to electrically connect a first wire 111 to a second wire 112, a second connecting mechanism 140 to electrically connect a first wire 113 to a second wire 114 and a third connecting mechanism 150 to electrically connect a first wire 115 to a second wire 116, as described below.

Figure 1D:
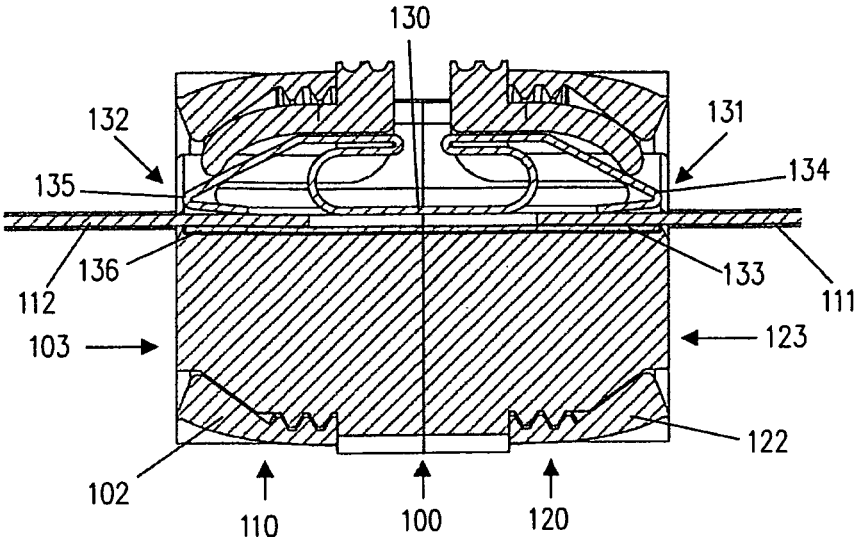
FIGS. 1D, 1E, 1F and 1G are simplified cross-sectional view illustrations of an electrical connector device of a type shown in FIGS. 1A-1C.

Reference is also made to FIG. 1D which schematically illustrate cross-sectional views of the device of FIG. 1B along section line "AA".

According to exemplary embodiments of the invention, device 100 may include a first conductive element 130, which may have a first clamping portion 131 and a second clamping portion 132, a second conductive element 140, which may have a first clamping portion 141 and a second clamping portion 142 (not shown), and a third conductive element 150, which may have a first clamping portion 151 and a second clamping portion 152 (not shown). Clamping portions 131, 132, 141, 142, 151 and/or 152 may each have an "open" state, e.g., to enable insertion of a wire, or a "closed" state, e.g., to clamp the wire, as described below.

According to exemplary embodiments of the invention, clamping portion 131 may include a spring element 134 and a first end section of a base element 133, clamping portion 132 may include a spring element 135 and a second end section of a base element 136, clamping portion 141 (not shown) may include a spring element 144 and a first end section of a base element 143, clamping portion 142 (not shown) may include a spring element 145 and a second end section of a base element 146, clamping portion 151 (not shown) may include a spring element 154 and a first end section of a base element 153, and clamping portion 152 (not shown) may include a spring element 155 and a second end section of a base element 156. Elements 130, 140 and/or 150 may be formed of any conductive material as is known in the art. For example, elements 130, 140 and/or 150 may be formed of brass, copper or steel.

According to exemplary embodiments of the invention, the spring element, e.g., element 134, may be positioned apart from the base element, e.g., element 133, for example, when the clamping portion, e.g., portion 131, is in the open state, to form a desired gap between the spring element and the base element.

According to exemplary embodiments of the invention, clamping portion 131 may be used to clamp wire 111, clamping portion 141 may be used to clamp wire 113 and clamping portion 151 may be used to clamp wire 115, for example, using locking mechanism 120, as described below. Additionally or alternatively, clamping portion 132 may be used to clamp wire 112, clamping portion 142 (not shown) may be used to clamp wire 114 and clamping portion 152 (not shown) may be used to clamp wire 116, for example, using locking mechanism 110, as described below.

According to some exemplary embodiments of the invention, device 100 may be used for clamping wires having different sizes. For example, one or more of wires 111, 112, 113, 114, 115, and/or 116 may have different size than the other wires. According to these embodiments, each of the clamping portions of device 100 may be adapted to allow inserting and/or clamping a corresponding wire. For example, the spring element and/or the base element of the clamping portion may be adapted to form a desired gap, e.g., corresponding to the wire to be clamped.

According to exemplary embodiments of the invention, each of the locking mechanism may be able to "lock" at least one of the clamping portions in its closed state. For example mechanism 120 may be able to lock, e.g., simultaneously, clamping portions 131, 141 and 151 in their closed state, and mechanism 120 may be able to lock, e.g., simultaneously, clamping portions 132, 142 (not shown) and 152 (not shown) in their closed state, as described below.

According to exemplary embodiments of the invention, mechanism 120 may be unlocked by releasing ring 122 and may be locked by fastening ring 122, as described below.

Figure 1E:
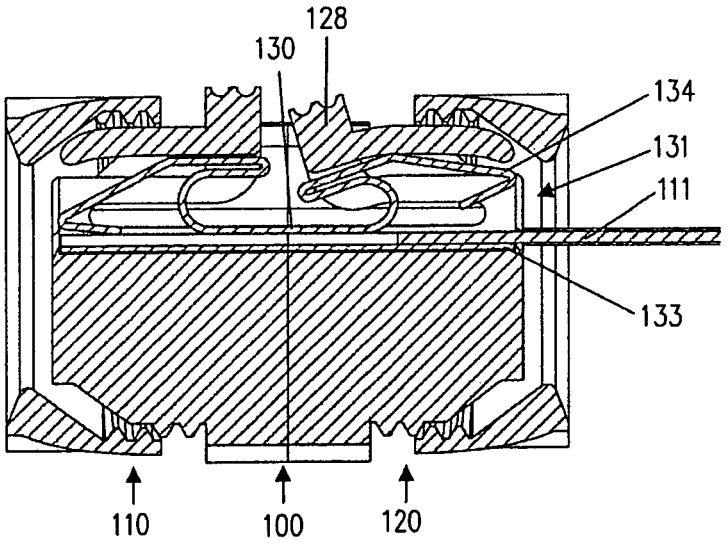

Reference is also made to FIG. 1E which schematically illustrate cross-sectional views of the device of FIG. 1B along section line "AA".

According to exemplary embodiments of the invention, clamping portion 131 of conductive element 130 may be in "open" state. For example, tab 128 may be pushed toward the center of body 100 and by that bending element 134, to allow insertion of wire 111.

According to exemplary embodiments of the invention, the user may insert wire 111 into the gap formed between elements 133 and 134.

Figure 1F:
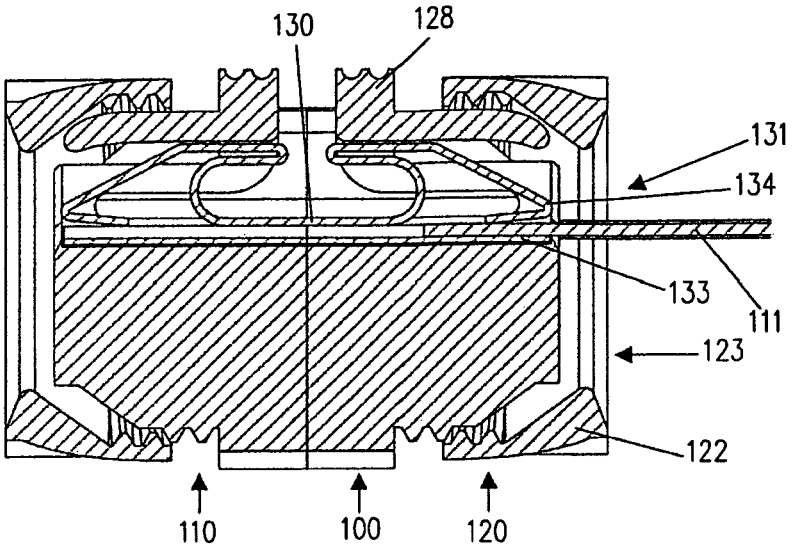

Reference is also made to FIG. 1F which schematically illustrates cross-sectional views of the device of FIG. 1B along section line "AA".

According to exemplary embodiments of the invention, clamping portion 131 of conductive element 130 may be in "closed" state. For example, when tab 128 is released spring element 134 may be urged to move towards element 133 to the closed state, to clamp wire 111 and hold it in position.

Figure 1G:
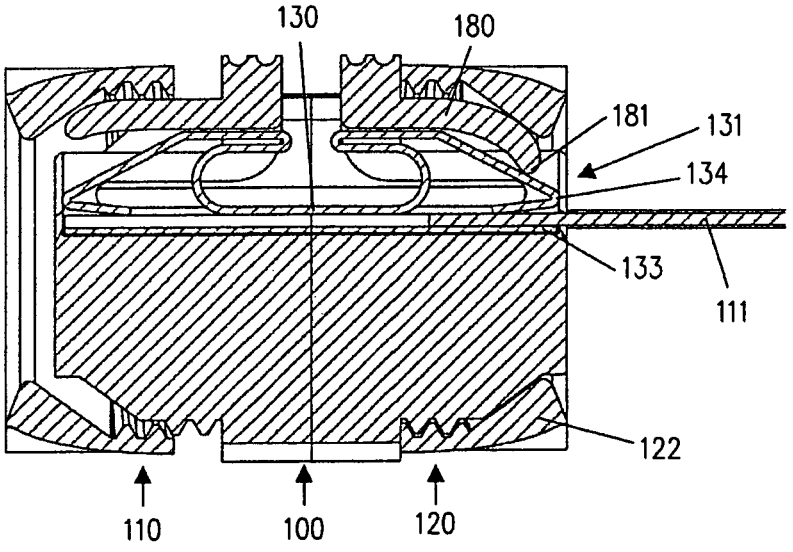

Reference is also made to FIG. 1G which schematically illustrate cross-sectional views of the device of FIG. 1B along section line "AA".

According to exemplary embodiments of the invention, fastening tab 180 may have a predetermined configuration, e.g., shape and/size, such that when ring 122 is fastened, an end portion 181 of fastening tab 180 may apply to element 134 a force urging element 134 toward element 133. When ring 122 is released portion 131 is able to move from the close state to the open state.

According to exemplary embodiments of the invention, the user may unlock mechanism 120 by releasing ring 122 until fastening tab 180 do not apply a force on element 134 sufficiently allow clamping portion 131 to move to the open state.

Thus, clamping portions 131, 141, and 151 may be, in the open or close state, when mechanism 120 is unlocked, e.g., when ring 122 is released. Clamping portions 131, 141, and 151 may be, e.g., in the close state, when mechanism 120 is locked, e.g., when ring 122 is fastened.

According to exemplary embodiments of the invention, the configuration and/or operation of clamping portion 132, 141, 142, 151 and/or 152 may be similar to the configuration and/or operation of clamping portion 131, e.g., as described above.

According to exemplary embodiments of the invention, the configuration and/or operation of conductive elements 140 and 150 may be similar to the configuration and/or operation of conductive element 130, e.g., as described above.

According to exemplary embodiments of the invention, the configuration and/or operation of locking mechanism 110 may be similar to the configuration and/or operation of locking mechanism 120, e.g., as described above.

Although the above discussion refers to inserting one electrical wire into each clamping portion of the electrical connecting device, it will be appreciated by those skilled in the art that electrical connecting devices according to other embodiments of the invention may include one or more clamping portions, each adapted to clamp more than one wire. For example clamping portion 131 may be adapted to clamp one or more wires, e.g., by designing base element 133, spring element 134, tabs 128 and 180 and/or ring 122 that a larger gap, e.g., corresponding to the total cross-section of the three wires, may be formed between elements 133 and 134 when portion 131 is in the open state. It may be also desired to modify the shape and/or size of body 105 and/or threaded surface 104, if, for example a relatively large number of wires is to be clamped by one or more clamping portions of device 100.

According to exemplary embodiments of the invention, ring 102 and/or ring 122 may have any desired configuration, for example, a configuration adapted to provide a comfortable grip of the ring, e.g., as described below.

Figure 2:
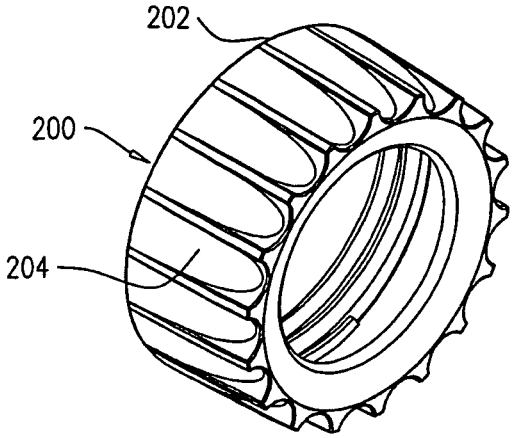
FIGS. 2, 3 and 4 are simplified schematic respective illustrations of portions of an electrical connector device of a type shown in FIGS. 1A-1G.

Reference is also made to FIG. 2, which schematically illustrate isometric view of the device of FIG. 1A.

According to exemplary embodiments of the invention, at least a portion of an outer contour 202 of ring 200 may be adapted to provide a comfortable grip of the ring 200. For example, contour 202 may include one or more generally grooves 204, e.g., to allow friction with a user's fingers.

Figure 3:
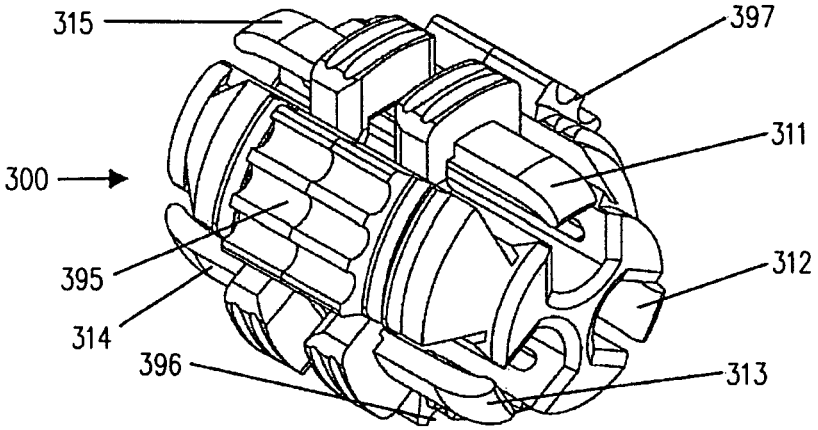

Reference is also made to FIG. 3, which schematically illustrate isometric view of the device of FIG. 1A.

According to exemplary embodiments of the invention, main body 300 may include gripping portions 395, 396, and 397 having a predetermined size and/or shape. For example, portion 395 may have a size and/or shape adapted to provide the user with a relatively comfortable grip of the device.

According to exemplary embodiments of the invention, main body 300 may include fastening tabs 311, 312, 313, 314, 315 and 316 (not shown) having a predetermined size and/or shape. For example fastening tab 311 may have a size and/or shape adapted to fasten element 134 toward element 133.

According to exemplary embodiments of the invention, one or more of the elements described above may be manufactured using molded elastic material, as described below. According to the other embodiments any other suitable material, e.g., as is known in the art, may be used.

Figure 4:
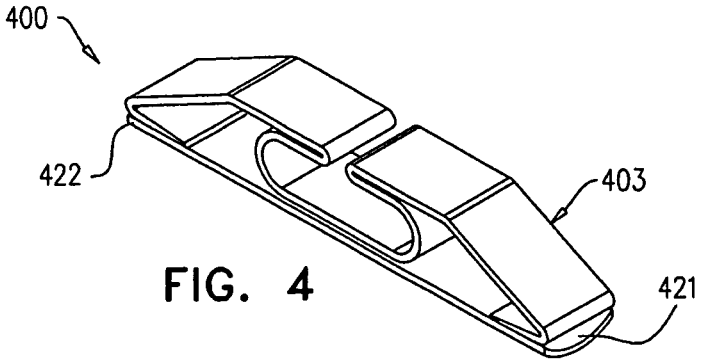

Reference is also made to FIG. 4, which schematically illustrate an isometric view of clamping and conductive element of the device of FIG. 1*a*. According to exemplary embodiments of the invention, element 400 may be manufactured using conductive and elastic material, e.g., brass, copper, or steel. According to exemplary embodiments of the invention, element 400 may include grooves 421 and 422 to provide better grip of the wires. For example, portion 403 may include one or more generally grooves 421, e.g., to allow friction with the wires.

Although the above discussion refers to an electrical connecting device including three connecting mechanisms to electrically connect three wires to three other wires, respectively, it will be appreciated by those skilled in the art that according to other embodiments, the electrical connecting device may be modified, to include one or more connecting mechanisms for electrically connecting one or more wires to one or more other wires, respectively.

According to exemplary embodiments of the invention, device 100 may also include an aperture for inserting an attachment element, e.g., a screw to attach device 100 to an external element, e.g., a surface of a desired unit or device.

According to exemplary embodiments of the invention, device 100 may also include a sealing mechanism, in order to become water resistant.

According to exemplary embodiments of the invention, device 100 may also include an inherent indicator, to indicate whether the electrical wires connected to it are active or not.

According to exemplary embodiments of the invention, device 100 may also include a mechanism to expose the wires.

Reference is now made to FIGS. 5A-5E, which are simplified respective perspective, end, side, cross-sectional and exploded view illustrations of a connector device in an initial, pre-actuated state, constructed and operative in accordance with another preferred embodiment of the present invention.

As seen in FIGS. 5A-5E, there is provided a connector device 500 comprising a device body 502, which device body 502 preferably has a first end 504 and a second end 506. As seen most clearly in FIGS. 5B and 5E, a first plurality of slots 508 is preferably formed in device body 502. First plurality of slots 508 preferably has a second plurality of openings formed at first end 504 of device body 502 and a third plurality of openings formed at second end 506 of device body 502. Here, by way of example, first plurality of slots 508 is embodied as a first slot 510, a second slot 512 and a third slot 514, the first plurality of slots 508 having a second plurality of openings 520 at first end 504 of device body 502 and a third plurality of openings 522 at second end 506 of device body 502. Second and third pluralities of openings 520, 522 are preferably respectively adapted for insertion of first and second sets of conductive wires therein, whereby the first and second sets of conductive wires may be mutually electrically connected, as will be detailed henceforth with reference to FIGS. 7A-8D.

First-third slots 510-514 preferably span a length of device body 502 and may have mutually generally equal dimensions. It is appreciated, however, that the inclusion of three similar slots in connector device 500 is exemplary only, and that connector device 500 may alternatively include a greater or fewer number of slots having generally the same or mutually differing dimensions.

A multiplicity of conductive clamping elements 530 is preferably disposed in first plurality of slots 508, the multiplicity of clamping elements 530 preferably comprising a first clamping spring disposed within each of the second plurality of openings 520 for clamping the first set of conductive wires therein and a second clamping spring disposed within each of the third plurality of openings for clamping the second set of conductive wires therein.

Here, by way of example, multiplicity of clamping elements 530 preferably comprises a first clamping spring 532 preferably disposed within first opening 520 of first slot 510 and a second clamping spring 534 preferably disposed within second opening 522 of first slot 510. A third clamping spring 538 and a fourth clamping spring 540 are preferably respectively disposed within first and second openings 520, 522 of second slot 512 and a fifth clamping spring 542 and a sixth clamping spring 544 are preferably respectively disposed within first and second openings 520, 522 of third slot 514. It is appreciated that each one of first-sixth clamping springs 532-544 is thus preferably located at an opening of the corresponding slot within which the respective clamping spring is disposed.

Each pair of first and second clamping springs 532 and 534, third and fourth clamping springs 538 and 540 and fifth and sixth clamping springs 542 and 544 may be integrally formed as a single, monolithic conductive clamping element, which conductive clamping element preferably includes a conductive bridge 546 extending between the respective pair of terminal clamping springs. Thus, first and second clamping springs 532, 534 may comprise a first clamping element 547, third and fourth clamping springs 538, 540 may comprise a second clamping element 548 and fifth and sixth clamping springs 542, 544 may comprise a sixth clamping element 549. Clamping elements 547, 548, 549 constitute members of multiplicity of clamping elements 530.

Each one of first-sixth clamping springs 532-544 is preferably cooperatively connected to a depressible tab 550 located on an exterior surface of device body 502, atop of each corresponding clamping spring. Tabs 550 are preferably adapted to cooperate with corresponding ones of clamping elements 530, so as to actuate connector 500 in a manner to be detailed henceforth.

Connector 500 further preferably includes a first rotatable fastening ring 554 located at first end 504 of device body 502 and a second rotatable fastening ring 556 located at second end 506 of device body 502. First and second fastening rings 554, 556 may comprise nuts, as seen most clearly in FIG. 5E. First and second fastening rings 554, 556 are preferably respectively rotatable over a threaded surface 557 provided at each of first and second ends 504, 506 of device body 502 for simultaneously fastening first and second sets of conductive wires in first plurality of slots 508, as will be detailed henceforth with reference to FIGS. 8A-8D.

In an initial, pre-actuated state of connector 500, seen in FIGS. 5A-5E, tabs 550 are preferably in a first, extended state, such that clamping springs of clamping elements 530 are in an uncompressed state. In its initial, pre-actuated state, connector 500 is not adapted for insertion of conductive wires therein.

Figure 5A:
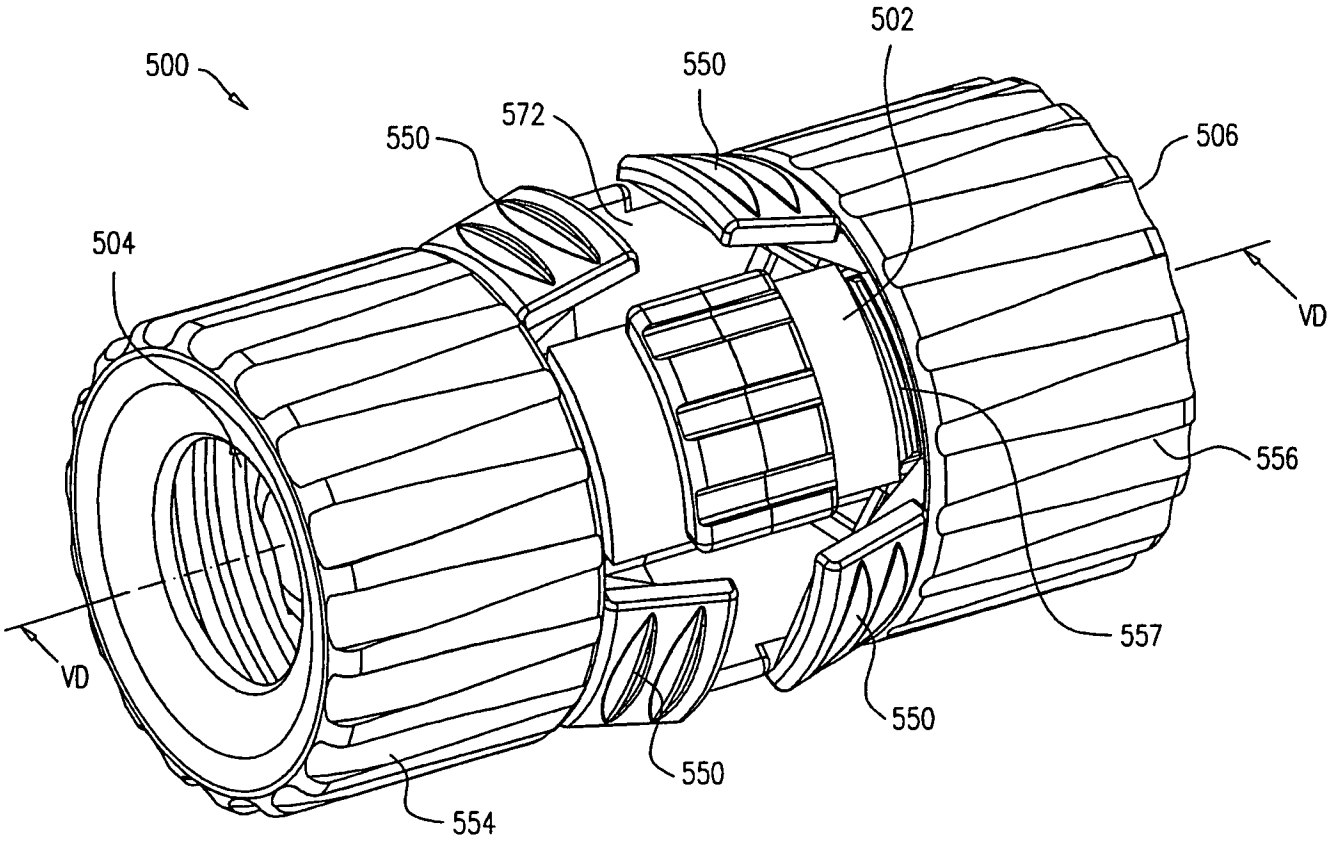
FIGS. 5A, 5B, 5C, 5D and 5E are simplified respective perspective, front, side, cross-sectional and exploded view illustrations of a connector device in a first, pre-actuated state, constructed and operative in accordance with another preferred embodiment of the present invention.
Figure 5B:
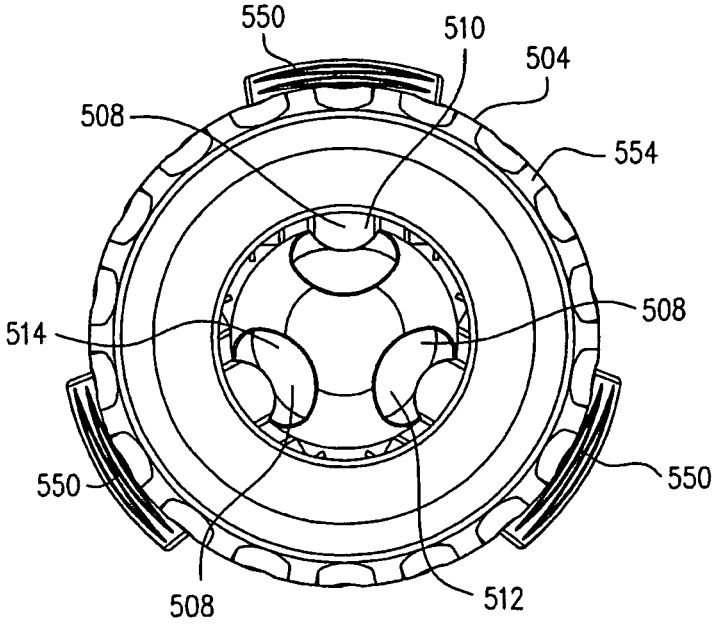
Figure 5C:
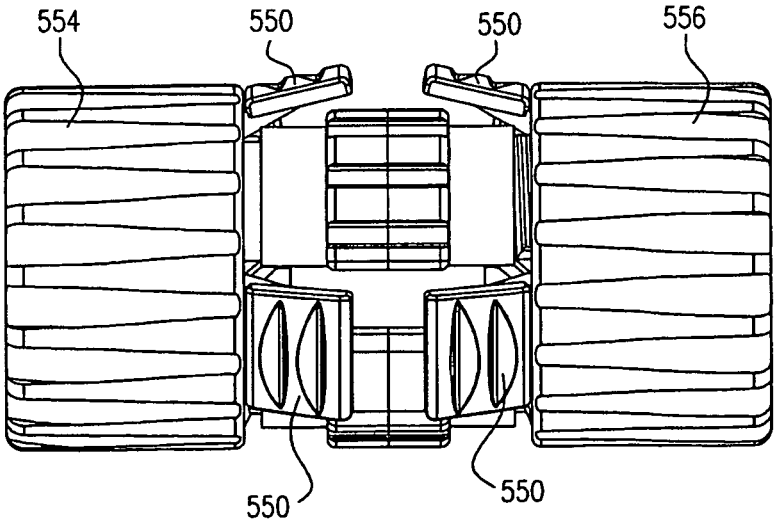
Figure 5D:
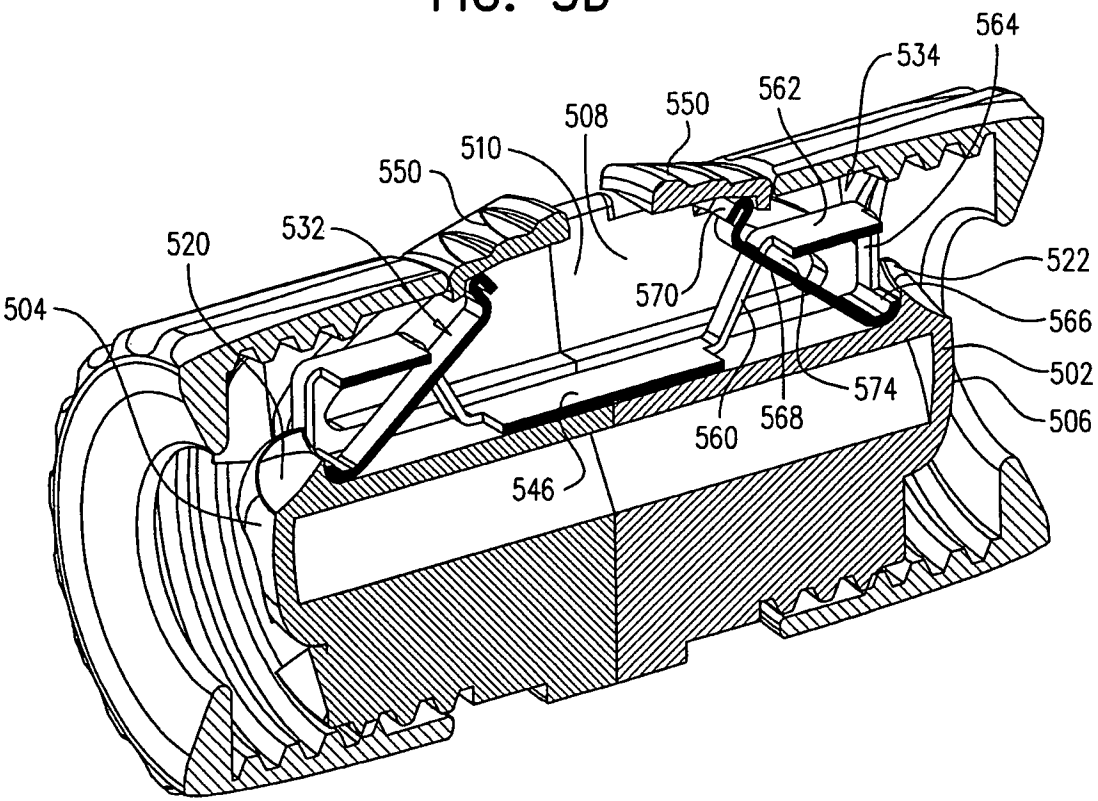
Figure 5E:
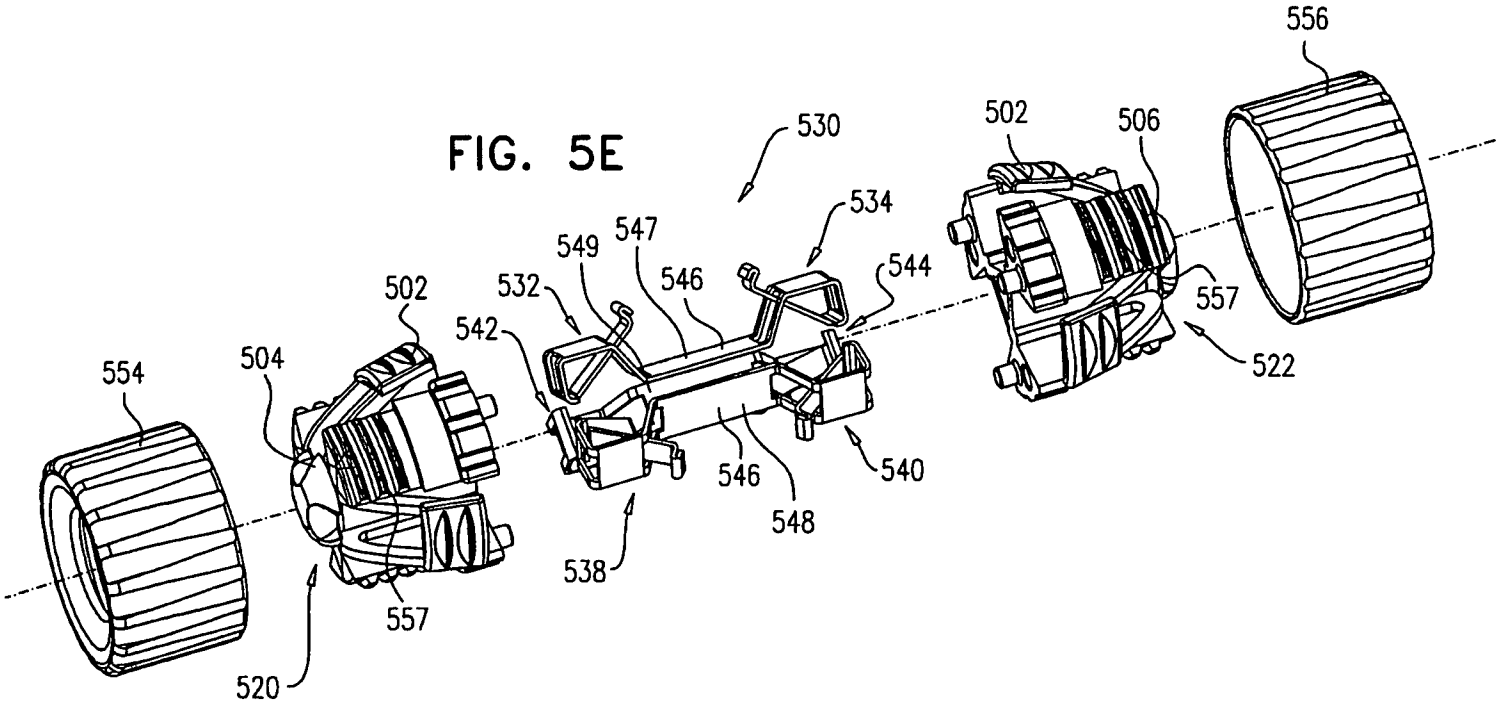

As seen most clearly in FIG. 5D, in the case of conductive clamping springs 532 and 534, each clamping spring may comprise an acutely angled elongate section 560 lying in a first plane and extending upwards from conductive bridge 546. Elongate section 560 is preferably contiguous with an upper widened flat lip 562, which lip 562 preferably extends outwards from the first plane so as to terminate in a second plane. A perpendicularly bent leg 564 preferably emerges from lip 562, which perpendicularly bent leg 564 preferably has an orthogonally angled foot 566, extending perpendicular to the first plane defined by elongate section 560. A slanted section 568 extends upwards from foot 566 in the second plane, generally parallel to the first plane but offset therefrom by a length of foot 566. It is appreciated that slanted section 568 is preferably configured so as to be at least partially coplanar with widened flat lip 562. Slanted section 568 terminates at a folded end section 570, which folded end section 570 extends upwards through an opening 572 in device body 502. Folded end section 570 is preferably capped by tab 550.

As seen most clearly in the case of clamping spring 534, a small gap 574 may be formed between widened flat lip 562 and slanted section 568 when tab 550 is in an extended state and thus clamping spring 534 is in an uncompressed state. Gap 574 is preferably too small to be suitable for insertion of a conductive wire therein. It is appreciated that section 568 may alternatively be positioned so as to touch a lower surface of lip 562 when tab 550 is in an extended state, such that no gap 574 is present therebetween. Connector 500 is thus not adapted for insertion of conductive wires therein when in its initial, pre-actuated state.

Reference is now additionally made to FIGS. 6A-6D, which are respective perspective, front, side and cross-sectional view illustrations of the connector device of FIGS. 5A-5E, in a second, actuated state; and to FIGS. 7A-7D, which are respective perspective, front, side and cross-sectional view illustrations of the connector device of FIGS. 6A-6D in its second, actuated state and with wires clamped therein.

As seen in FIGS. 6A-7D, connector 500 may be actuated by depression of tabs 550. Tabs 550 may be easily manually compressed by a user of connector 500, without requiring the use of any tools. As seen most clearly in the case of clamping springs 532, 534 in FIG. 6D, tabs 550 may be depressed, whereby tabs 550 compress clamping springs 532, 534 by way of exertion of a force on terminal folded sections 570. As a result of depression of tabs 550, folded sections 570 are correspondingly depressed, such that slanted sections 568 are moved downwards, in a direction away from depressing tabs 550. The downward movement of slanted sections 568 leads to the widening of gap 574 between slanted section 568 and widened flat lip 562.

It is appreciated that although the depression of clamping elements 530 is described and illustrated with respect to clamping springs 532 and 534, corresponding depression of clamping springs 536-544 occurs upon depression of corresponding tabs 550.

As best seen in FIGS. 7A-7D, the widening of gaps 574 as a result of depression of tabs 550 allows a multiplicity of conductive wires 580 to be inserted and clamped into slots 508 of connector device 500. Here, by way of example, multiplicity of wires 580 may comprise a first set of wires 582 inserted in second plurality of openings 520 at first end 504 of device 500 and a second set of wires 584 inserted in third plurality of openings 522 at second end 506 of device 500. Multiplicity of conductive wires 580 may be manually inserted in device 500 by a user thereof, without requiring the use of any specialized tools.

First set of wires 582 may comprise a first wire 586 inserted and clamped in first clamping spring 532 at a first end of first slot 510, a second wire 588 inserted and clamped in third clamping spring 538 at a first end of second slot 512 and a third wire 590 inserted and clamped in fifth clamping spring 542 at a first end of third slot 514. Second set of wires 584 may comprise a fourth wire 592 inserted and clamped in second clamping spring 534 at a second end of first slot 510, a fifth wire 594 inserted and clamped in fourth clamping spring 540 at a second end of second slot 512 and a sixth wire 596 inserted and clamped in sixth clamping spring 544 at a second end of third slot 514. It is appreciated that wires 580 are preferably of a diameter such that each one of wires 580 may be inserted into a corresponding one of clamping elements 530 and be clamped therein, due to the spring action of clamping springs 530. It is further appreciated that clamping elements 530 are preferably operative to clamp but not securely fasten wires 580 when wires 580 are inserted therein. In the state of connector 500 illustrated in FIGS. 7A-7D, wires 580 are thus clamped but not securely fastened in connector 500.

It is understood that the strength of clamping of wires 580 in clamping elements 530 is preferably influenced by a size of gap 574. The smaller the width of gap 574, the stronger the clamping action of the clamping springs on the wires 580 held therein.

Figure 7A:
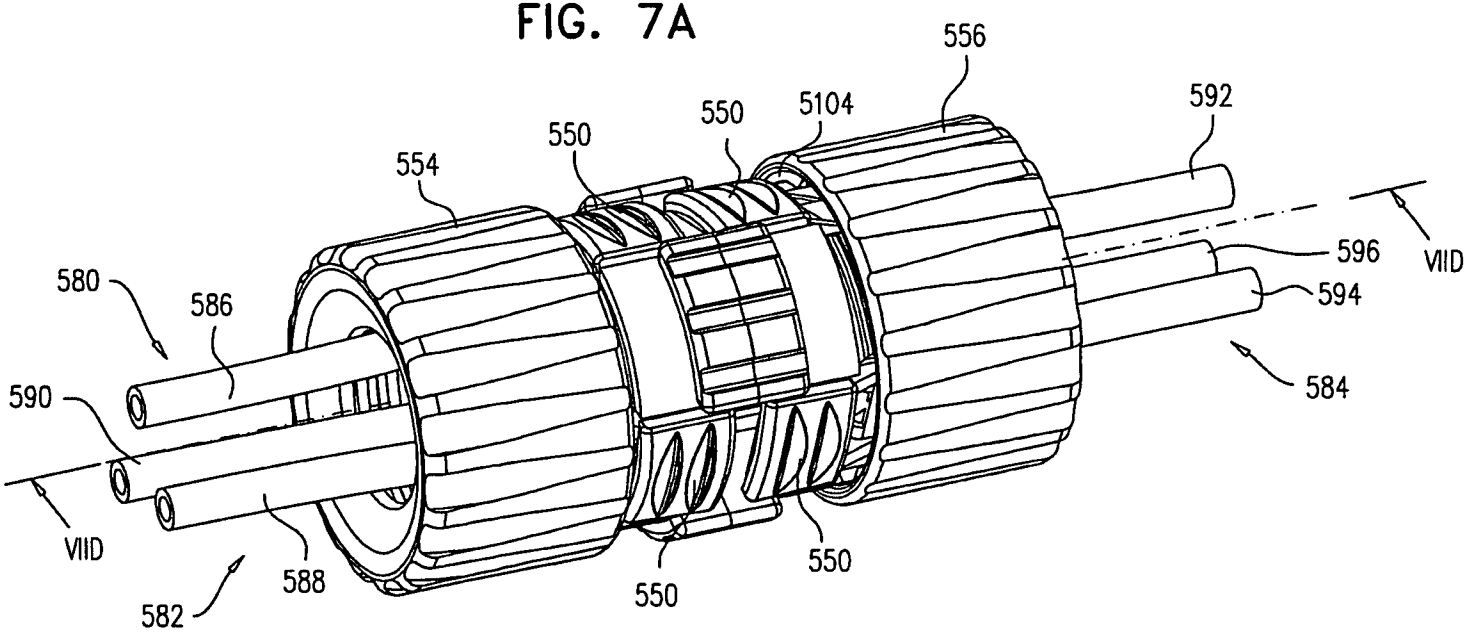
FIGS. 7A, 7B, 7C and 7D are simplified respective perspective, front, side and cross-sectional view illustrations of the connector device of FIGS. 5A-6D, in the second, actuated state and having wires clamped but not securely fastened therein, constructed and operative in accordance with a preferred embodiment of the present invention.
Figure 7B:
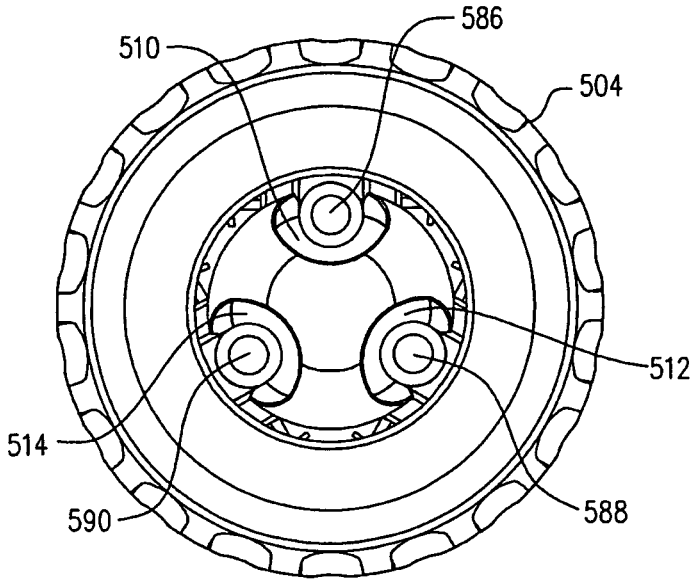
Figure 7C:
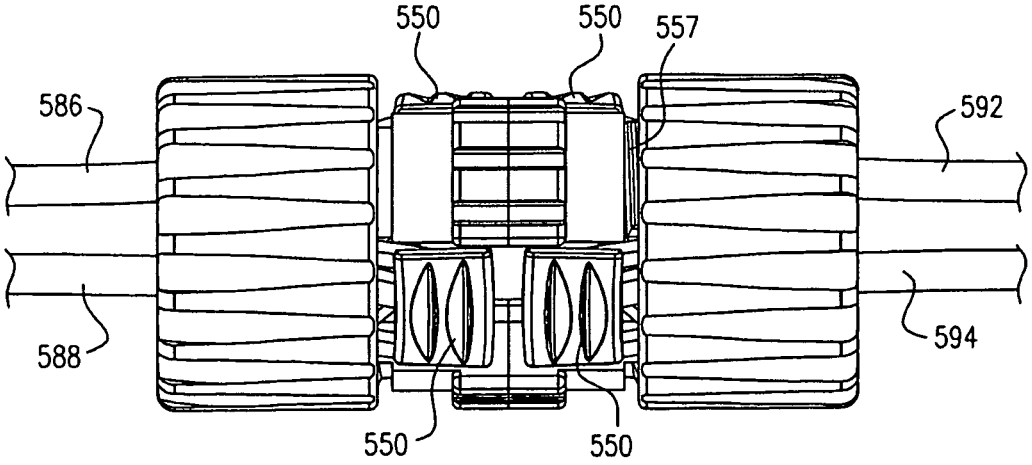
Figure 7D:
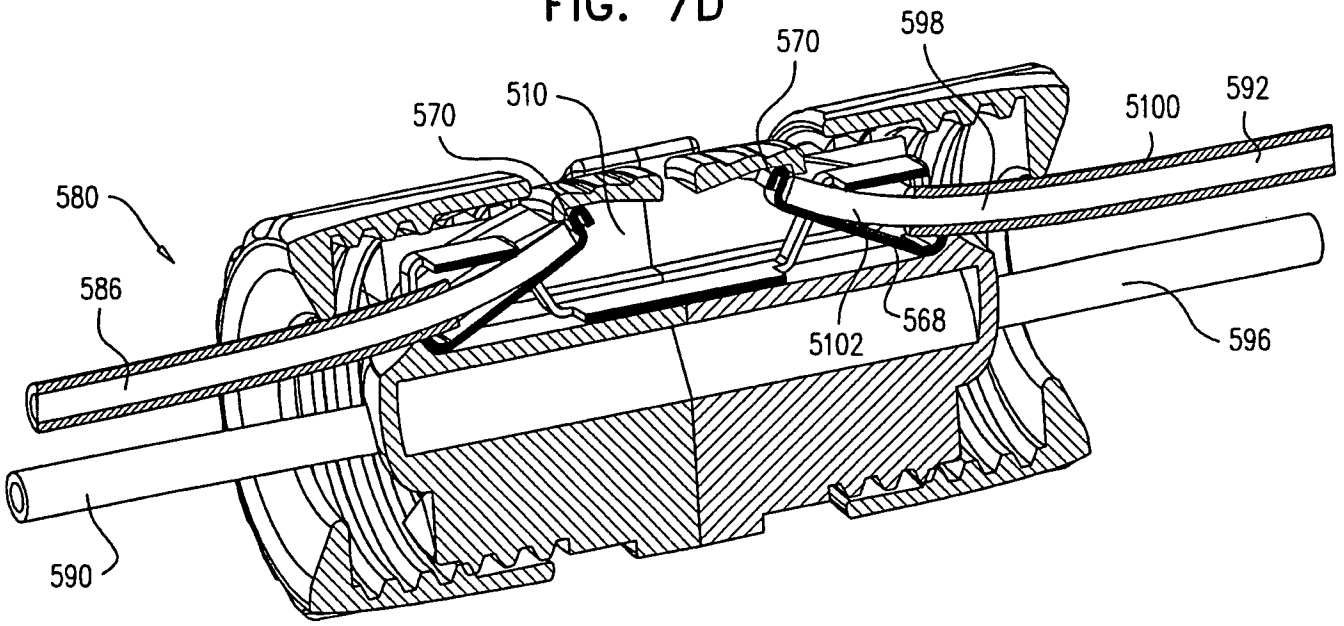
Figure 8A:
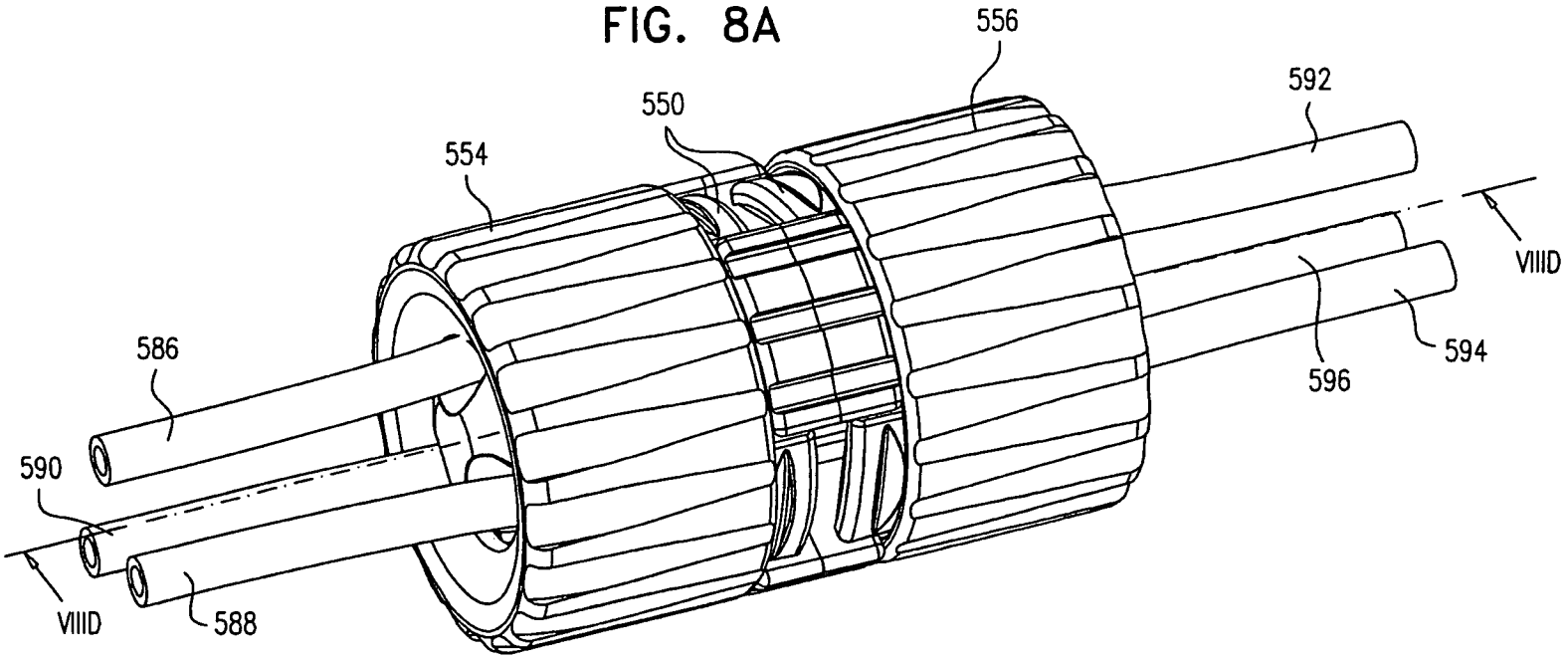
FIGS. 8A, 8B, 8C and 8D are simplified respective perspective, front, side and cross-sectional view illustrations of the connector device of FIGS. 5A-7D, in a third, actuated state, having wires clamped and securely fastened therein, constructed and operative in accordance with a preferred embodiment of the present invention.
Figure 8B:
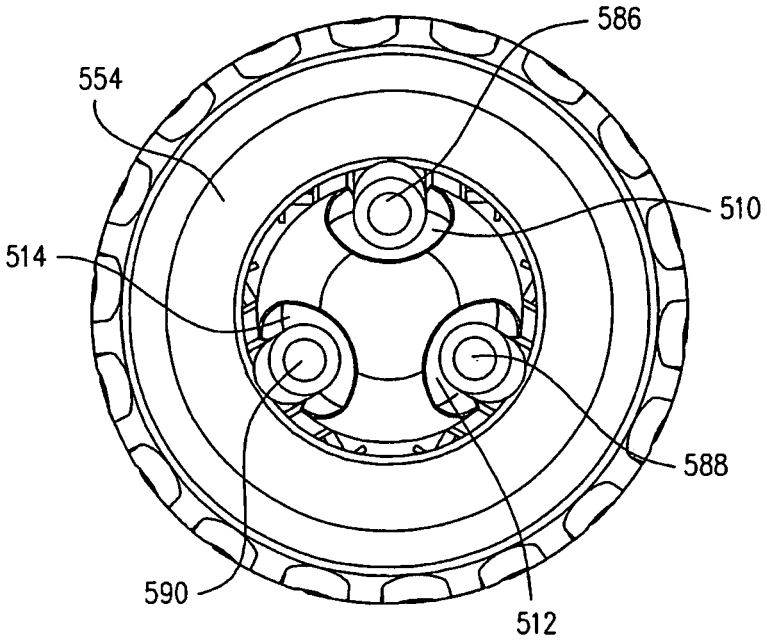
Figure 8C:
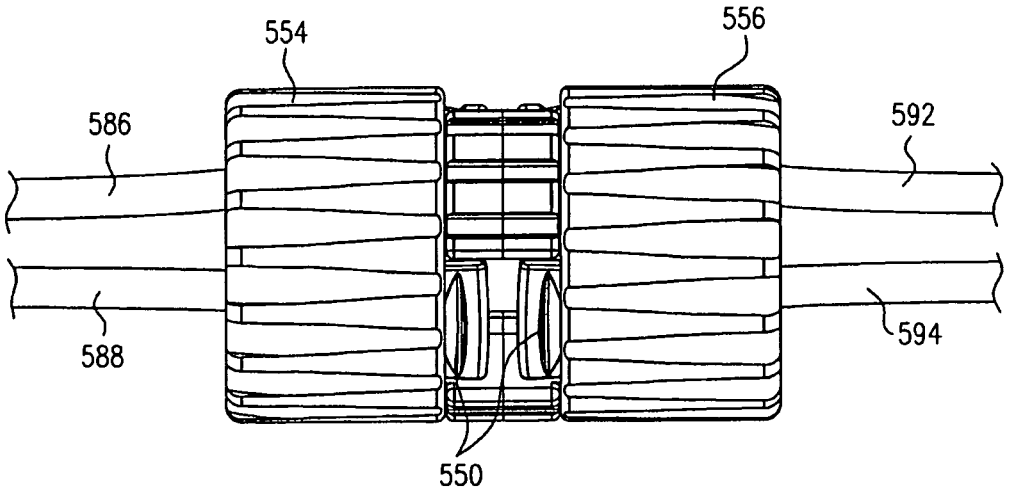
Figure 8D:
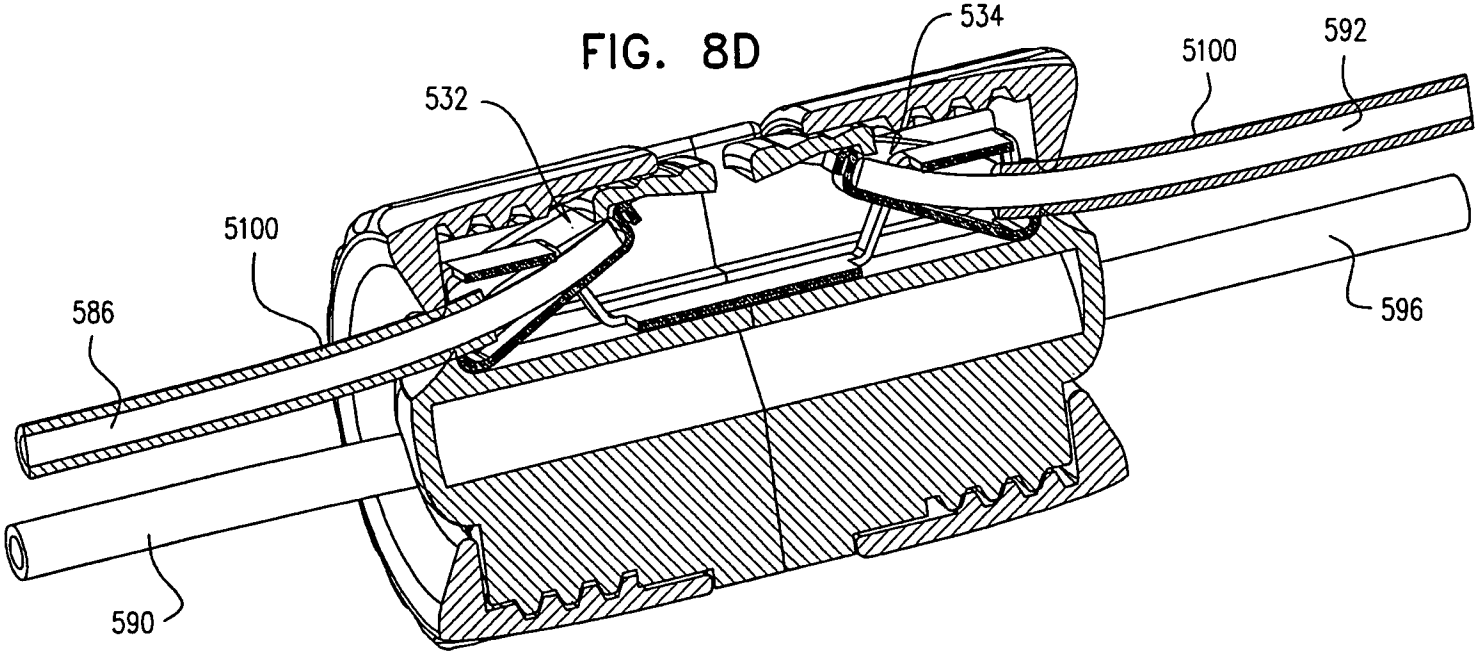

As seen most clearly in FIG. 7D, wires 580 may be inserted into slots 508 up until an end of wires 580 meets folded section 570 of clamping elements 530. Folded section 570 preferably forms a barrier preventing deeper insertion of wires 580. Each one of wires 580 preferably comprises an inner conductive core 598 and an outer insulative sheath 5100. Outer insulated sheath 5100 preferably surrounds inner conductive core 598, save for a portion 5102 of inner conductive core 598 extending beyond a limit of outer insulative sheath 5100. As seen in FIG. 7D, wires 580 are preferably clamped in clamping elements 530 such that portion 5102 of wires 580 is entirely enclosed by device 500 and outer insulative sheath 5100 extends outwards beyond respective ends 504 and 506 of device 500.

As appreciated from consideration of FIG. 7D, portion 5102 preferably rests on slanted section 568 when wires 580 are held in clamping elements 530, such that portion 5102 conforms to the contours of slanted section 568 and is itself slanted. The slanted orientation of portion 5102 preferably enhances the efficacy of the clamping action of clamping elements 530 on wires 580.

Figure 6A:
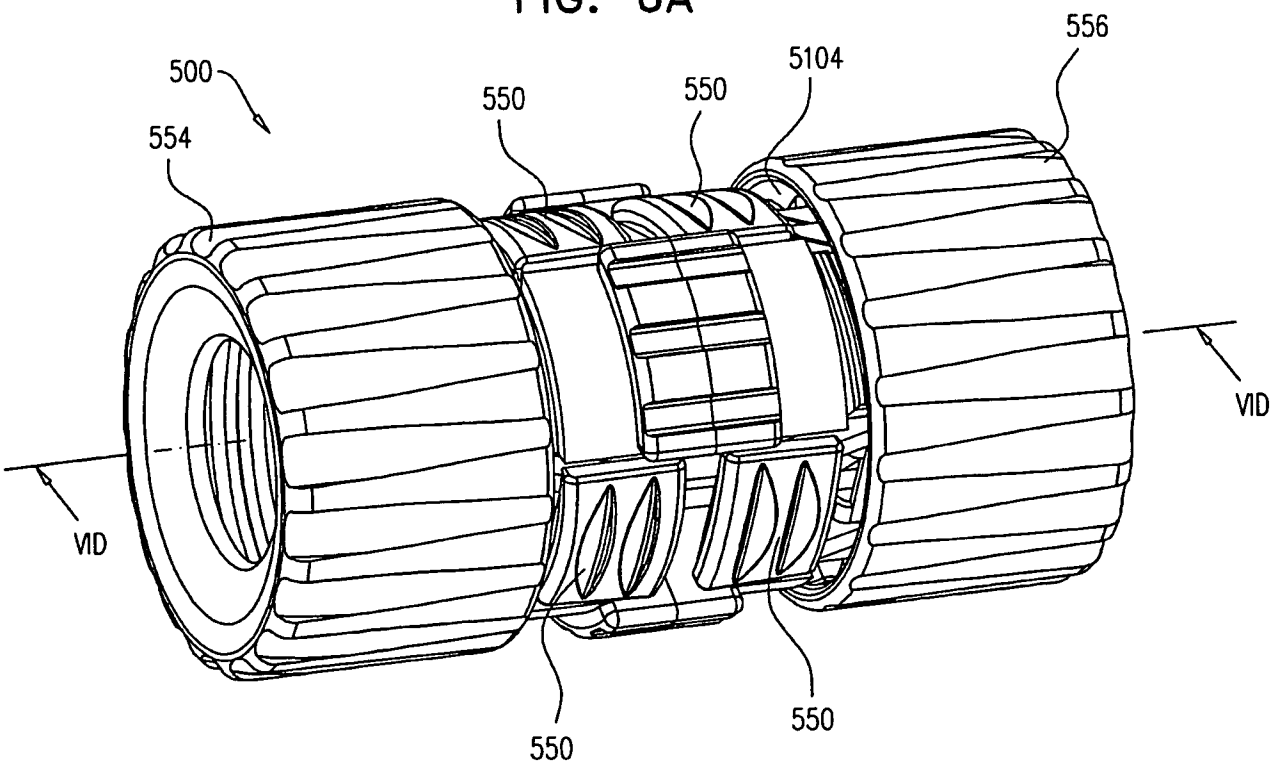
FIGS. 6A, 6B, 6C and 6D are simplified respective perspective, front, side and cross-sectional view illustrations of the connector device of FIGS. 5A-5E, in a second, actuated state, constructed and operative in accordance with a preferred embodiment of the present invention.
Figure 6B:
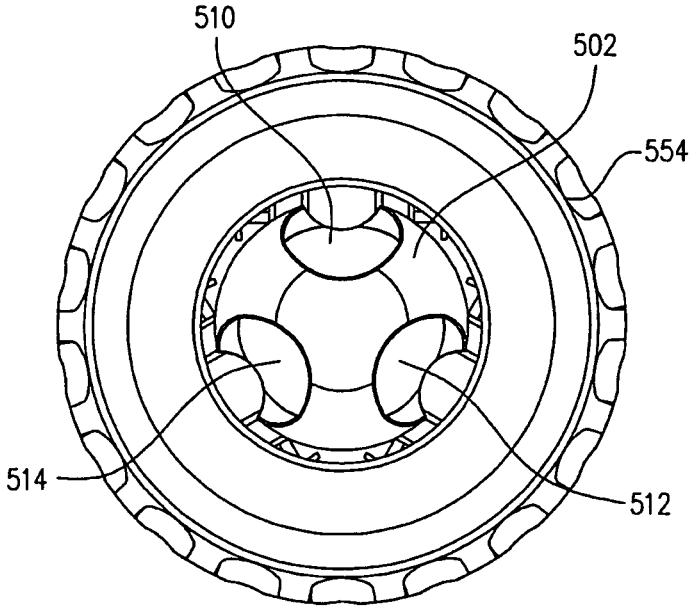
Figure 6C:
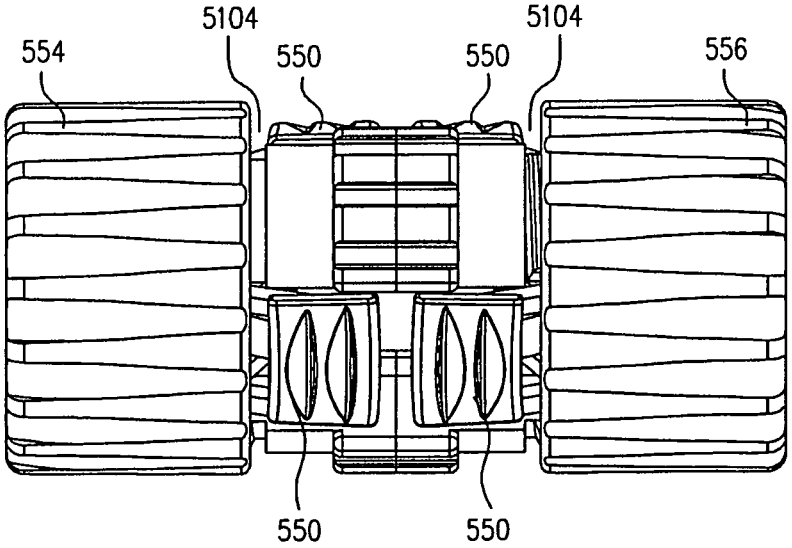
Figure 6D:
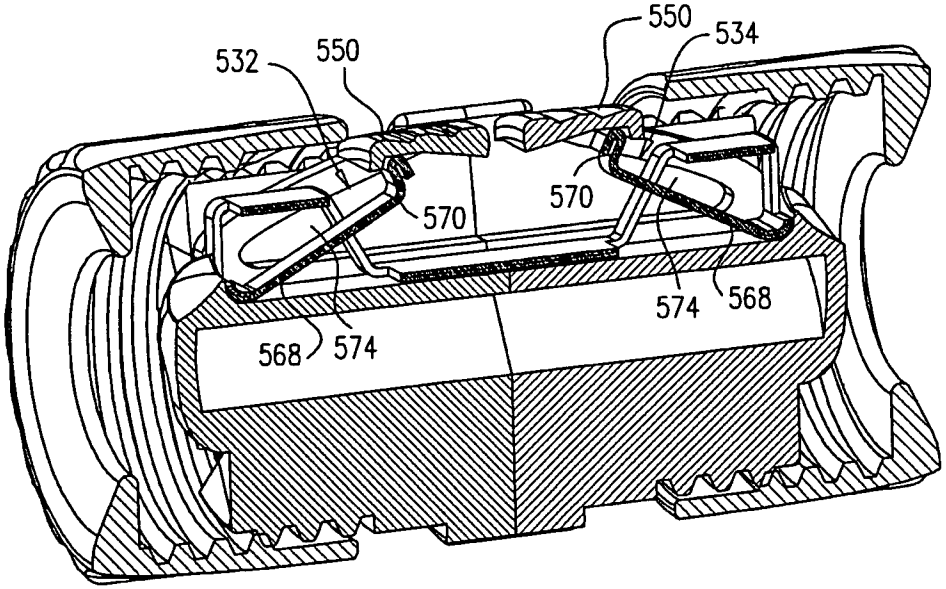

As best seen in FIGS. 6A and 6C, the depression of tabs 550 leads to the creation of an expanse 5104 on an exterior surface of device body 502 between each one of rings 554 and 556 and adjacent tabs 550. The creation of expanse 5104 between rings 554 and 556 and tabs 550 allows rings 554 and 556 to be rotated over threaded regions 557 at respective ends 504 and 506 of device body 502, and thereby over corresponding ones of clamping elements 530, as illustrated in FIGS. 8A-8D. It is appreciated that when tabs 550 are in an extended state, expanse 5104 is occupied by tabs 550 such that rings 554 and 556 are prevented from being rotated inwards.

As seen in FIGS. 8A-8D, first ring 554 may be rotated over threaded region 557 at first end 504 of device body 502 and thus over openings 520 of slots 510-514 and clamping elements 532, 538 and 542 disposed therein. Similarly, second ring 556 may be rotated over threaded region 557 at second end 506 of device body 502 and thus over openings 522 of slots 510-514 and clamping elements 534, 540 and 544 disposed therein. As a result of rotation of first ring 554 over first end 504 of device body 502, an inner rim of ring 554 grasps outer insulative sheath 5100 of first set of wires 582, thereby securely fastening first set of wires 582 in device 500. It is appreciated that the rotation of first ring 554 thus simultaneously fastens each of the wires 586, 588, 590 comprising first set of wires 582 in device 500.

Similarly, as a result of rotation of second ring 556 over clamping elements 534, 540 and 544, an inner rim of second ring 556 grasps outer insulative sheath 5100 of second set of wires 584, thereby securely fastening second set of wires 584 in device 500. It is appreciated that the rotation of second ring 554 thus simultaneously fastens each of the wires 592, 594, 596 comprising second set of wires 584 in device 500.

The fastening of multiplicity of wires 580 in device 500 by way of rotational grasping of the insulative sheath 5100 thereof by rings 554 and 556 is a particularly advantageous feature of a preferred embodiment of the present invention. This is because the fastening of wires 580 in this manner provides stress-relief, ensuring that stresses are exerted on the insulative sheath 5100 of the wires 580 rather than on conductive segments thereof. The provision of stress-relief concurrently and inherently with the fastening of wires 580 in device 500 obviates the need for additional stress-relief mechanisms to be used in conjunction with wires 580 in device 500, which additional mechanisms are typically complex and require the use of additional components.

It is appreciated that when first and second sets of wires 582 and 584 are clamped and fastened in device 500, as illustrated in FIGS. 8A-8D, corresponding generally collinear wires of first and second sets of wires are in galvanic contact with conductive clamping elements 530 and thus are mutually electrically connected by way of conductive bridge 546 formed between corresponding collinear clamping springs. Thus, first wire 586 is electrically connected to corresponding fourth wire 592 by way of clamping element 547, second wire 588 is electrically connected to corresponding fifth wire 594 by way of clamping element 548 and third wire 590 is electrically connected to corresponding sixth wire 596 by way of clamping element 549. An electrical testing device (not shown) may be inserted in opening 572 of device body 502 in order to detect the presence of an electric current in device 500 and thus verify that first and second sets of wires 582 and 584 are properly electrically connected following fastening thereof in device 500.

In order to remove wires 580 from device 500, a user may rotate rings 554 and 556 in a direction away from corresponding adjacent tabs 550. Rings 554 and 556 may each include an internal or external stopper mechanism in order to prevent rings 554 and 556 from being rotated too far by a user and falling off device body 502. Tabs 550 may then be released by a user, by way of example, by pressing thereon. Device 500 is thus returned to its first, pre-actuated state for further use. It is appreciated that when rings 554 and 556 are rotated so as to fasten wires 580 in device body 502, rings 554 and 556 preferably at least partially envelop adjacent tabs 550. Accidental release of tabs 550 when device 500 is in its actuated, fastened state is thereby prevented.

It is appreciated that although device 500 is illustrated herein in FIGS. 7A-8D in conjunction with three sets of connected wires, namely first and fourth wires 586 and 592, second and fifth wires 588 and 594 and third and sixth wires 590 and 596, device 500 may alternatively be used to connect a fewer number of wires, depending on the user requirements.

It is understood that multiplicity of wires 580 may be embodied as single or multi-strand wires or cables and may have a variety of structures and functionalities, as are well known in the art. It is further understood that device 500 may be adapted for use with wires having a range of diameters, by way of adjustment of the dimensions of plurality of slots 508 and clamping elements 530, as will be readily understood by one skilled in the art.

Figure 9A:
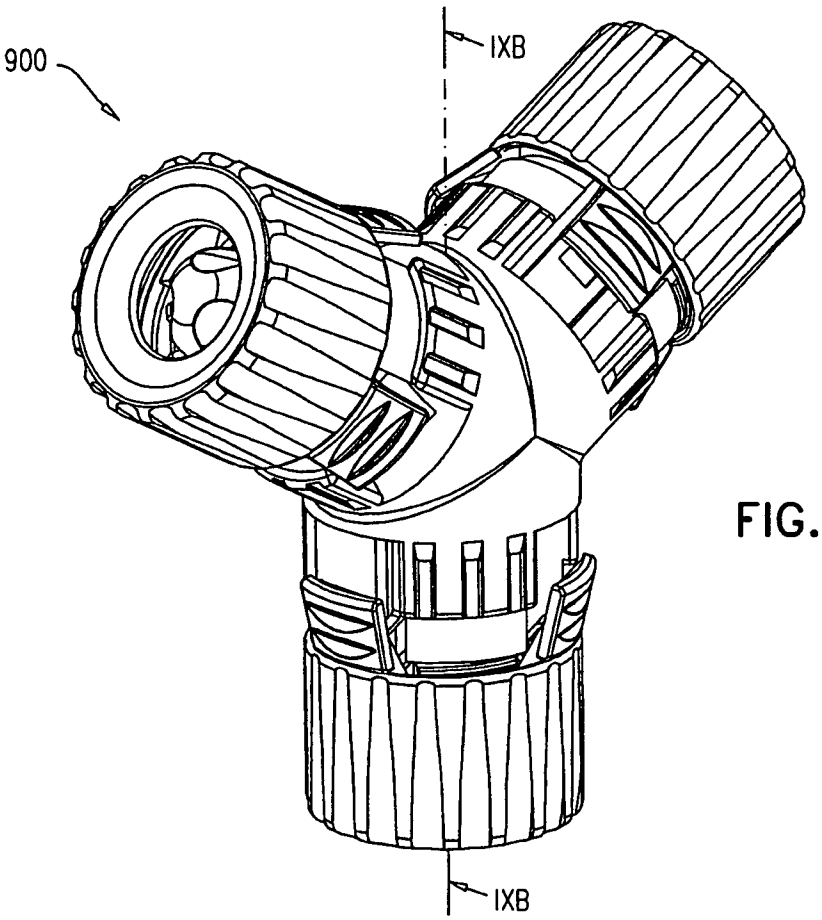
FIGS. 9A and 9B are simplified respective perspective and cross-sectional views of a connector device constructed and operative in accordance with a further preferred embodiment of the present invention.
Figure 9B:
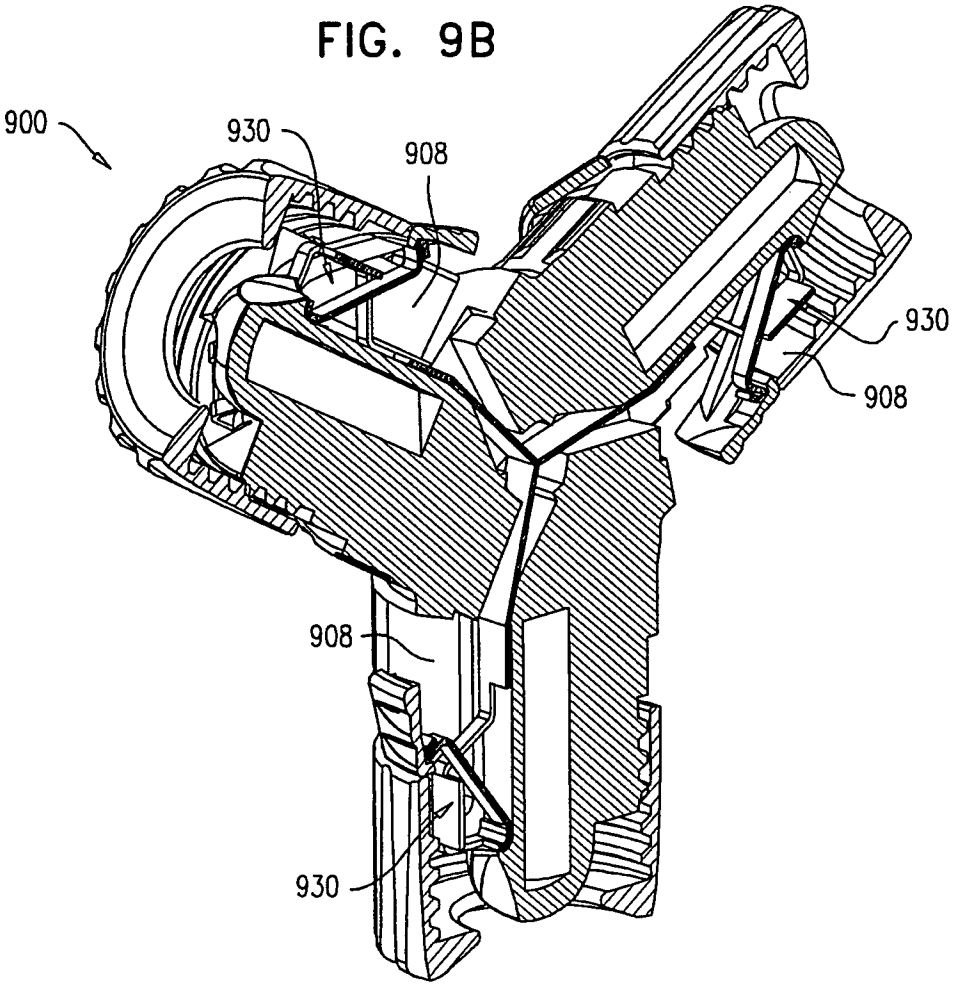

As appreciated from consideration of device 500, device 500 may be a dual-junction device, serving to electrically connect a first and a second set of wires therein. It is understood, however, that device 500 may alternatively comprise other multi junction devices, such as a device 900 illustrated in FIGS. 9A and 9B. As seen in FIGS. 9A and 9B, device 900 may comprise a three junction Y-shaped device, including a plurality of slots 908 housing a multiplicity of clamping elements 930. Device 900 preferably serves to electrically connect three sets of wires thereacross. It is appreciated that device 500 may alternatively be embodied in other multi junction configurations for connecting more than two sets of wires thereacross, including, by way of example, T-shaped and X-shaped connector devices.

Figure 10A:
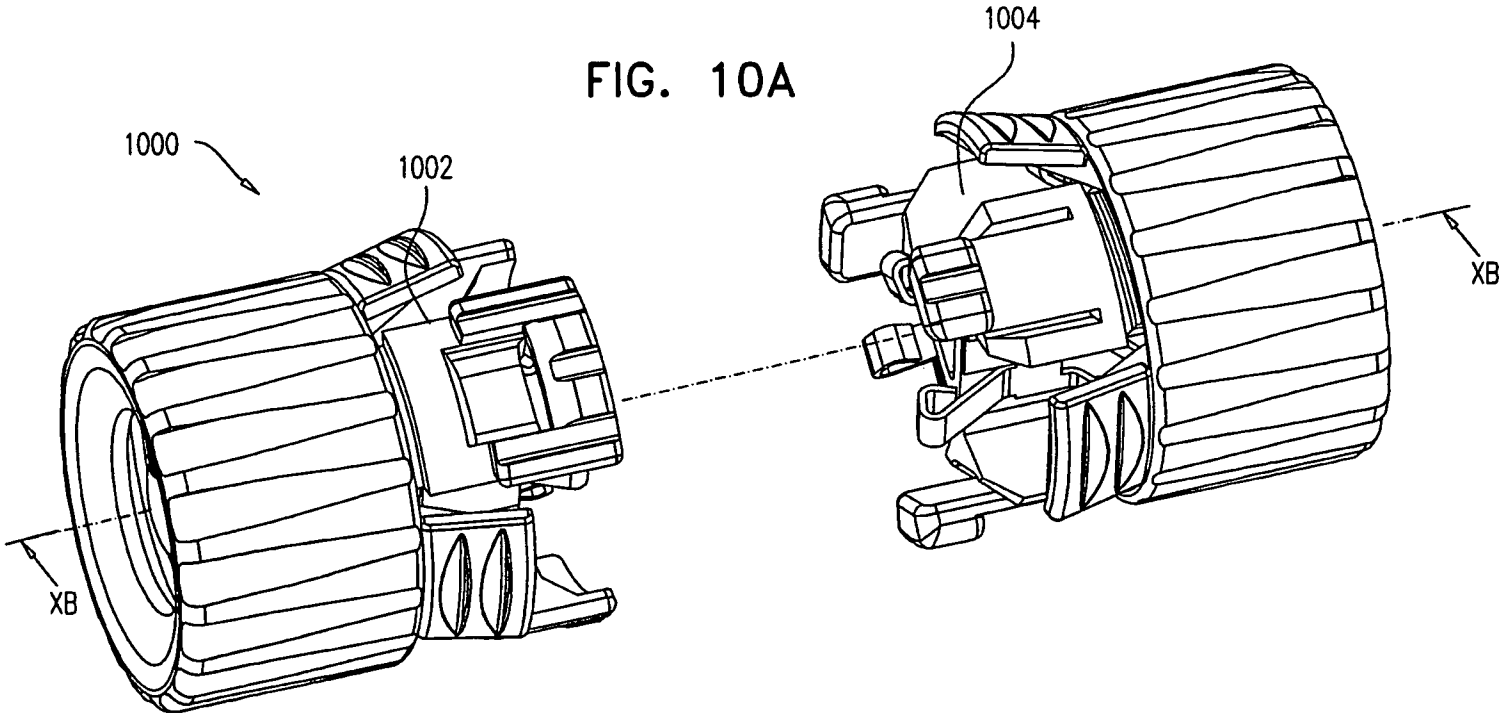
FIGS. 10A, 10B and 10C are simplified respective unassembled, unassembled cross-sectional and assembled view illustrations of a connector device constructed and operative in accordance with still another preferred embodiment of the present invention.
Figure 10B:
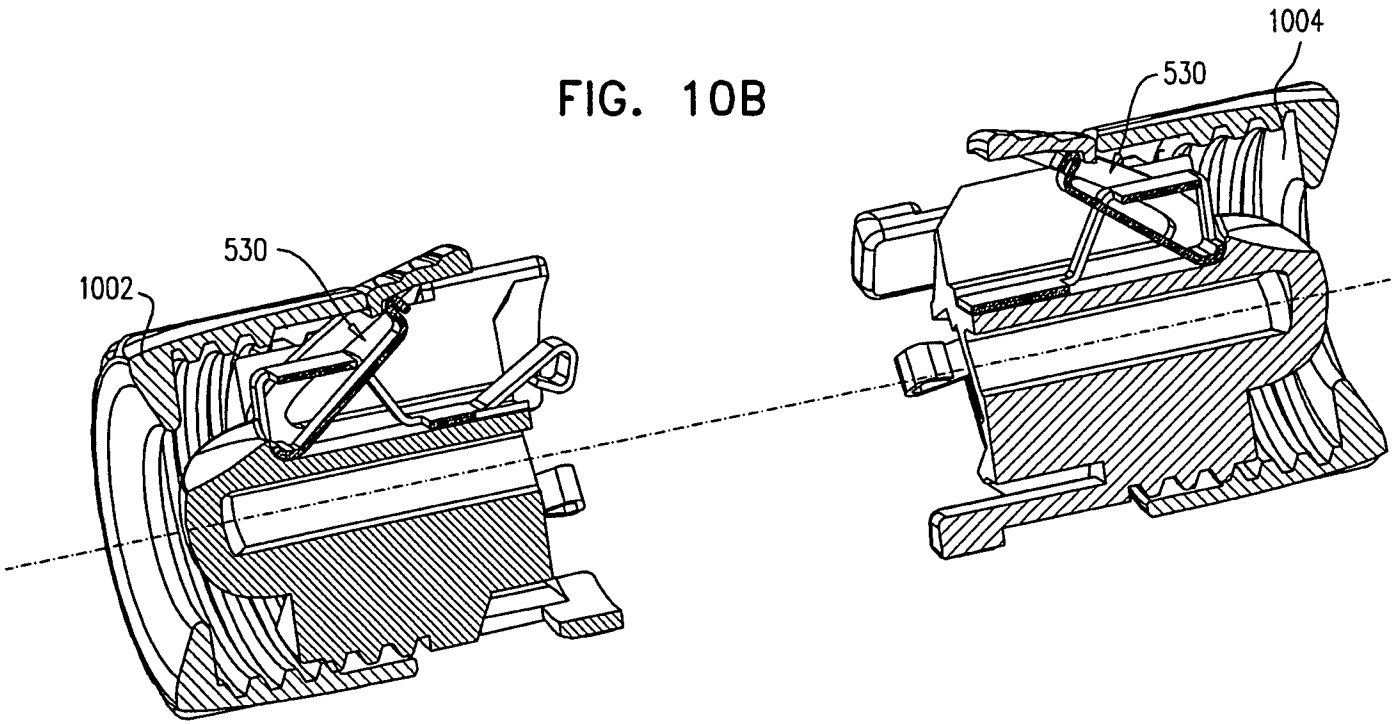
Figure 10C:
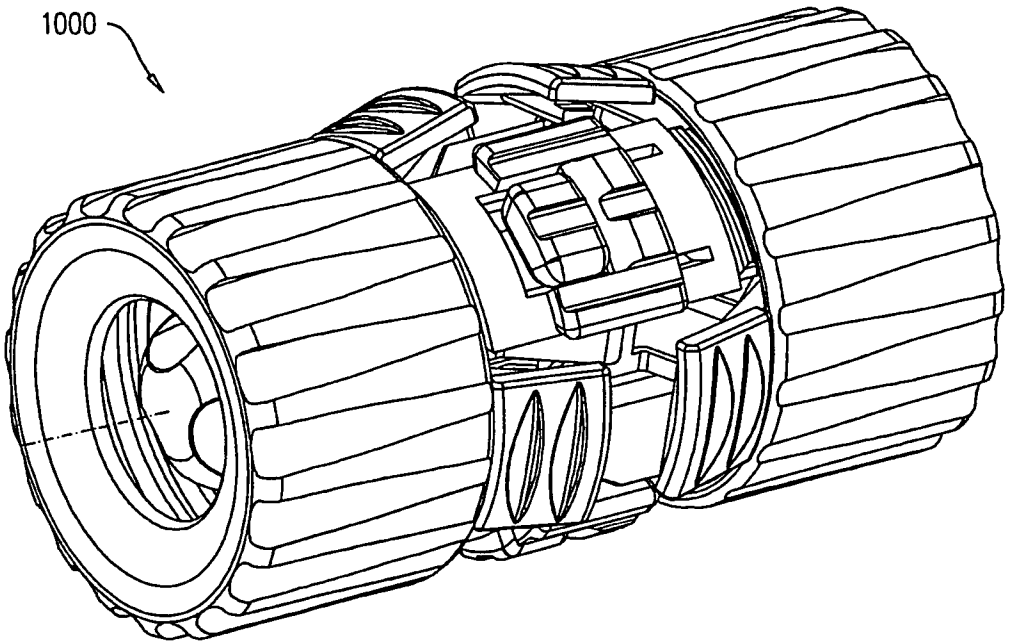

Device body 502 may comprise a single element when in use, as illustrated in FIGS. 5A-8D. Device body 502 may alternatively comprise first and second individual interlocking portions, as seen in the case of a connector device 1000 illustrated in FIGS. 10A-10C. Connector device 1000 may generally resemble connector device 500 in operation and structure thereof, with the exception of connector device 1000 being formed by a first element 1002 and a second, independently usable element 1004, in contrast to the unitary usable structure of device body 502. Connector device 1000 may be useful in cases where the use of two separate connector elements in conjunction with multiple sets of wires is required.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. A device for connecting wires comprising:

a device body having a first end portion and a second end portion;

a plurality of openings including a first set of at least two openings in said first end portion and a second set of at least two openings in said second end portion;

a plurality of slots on said first end portion of said device body;

a multiplicity of conductive clamps; a respective clamp of said multiplicity of conductive clamps disposed in each corresponding opening of said plurality of openings and a respective slot of said plurality of slots is associated with said each corresponding opening;

a first set of conductive wires including at least one respective conductive wire conductively connected to each said respective conductive clamp in each corresponding opening of said first set of at least two openings;

a first fastening ring rotatable over said first end portion of said device body for simultaneously rotationally fastening each said respective conductive wire of said first set of conductive wires to said respective slot of said corresponding opening of said first set of openings;

a second set of conductive wires including at least one respective conductive wire conductively connected to each said respective conductive clamp in each corresponding opening of said second set of at least two openings;

a respective conducting bridge conductively connecting a respective conductive clamp disposed in each said corresponding opening of said first set of at least two openings to a conductive clamp disposed in one said corresponding opening of said second set of at least two openings wherein each clamp of said multiplicity of conductive clamps is operatively coupled to a depressible tab located on an exterior surface of said device body and wherein said clamp is opens by pressing said depressible tab.

2. A device according to claim 1, wherein each conductive wire of said first set of conductive wires comprises a conductive core and an insulative sheath, and wherein said first fastening ring and said plurality of slots are position for said simultaneously rotationally fastening a respective insulative sheath of each said respective conductive wire of said first set of conductive wires to said respective slot of said corresponding opening of said first set of openings.

3. A device according to claim 1, wherein said each clamp comprises:

a bent conductive strip including said conductive bridge and an elongate section oriented at an acute angle directed upward from said conductive bridge, said elongate section bounded on one edge by a first plane;

an upper widened flat lip contiguous with said acutely angled elongate section, said lip extending across said first plane, an edge of said lip situated past said first plane on a side opposite said elongate section; said edge bounded by a second plane;

a downward oriented leg contiguous to said lip, said leg; and a slanted section extending upwards from said leg towards said bridge and lying between said first plane and said second plane, said slanted section terminating at a folded end section, said folded end section being capped by said depressible tab and, wherein each wire of said first set of conductive wires and said second set of conductive wires includes a conductive core and wherein a gap is defined between said lip and said slanted section, said gap being widened so as to permit insertion therein upon depression of said depressible tab of at least one said conductive core.

4. A device according to claim 1, wherein said device body comprises a unitary element when in use.

5. A device according to claim 1, wherein said device body and said conductive bridge comprise two interlocking elements wherein said first end portion is on a first of said two interlocking elements and said second is on a second of said two interlocking elements.

6. A device according to claim 1, wherein said device body comprises a multi junction element for mutually connecting said first and second sets of conductive wires to a third set of conductive wires.

7. A method for electrically connecting to a device, a plurality of wires each wire of said plurality of wires including a conductive core and an insulating sheath comprising:

providing a rigid device body having a first plurality of slots at a first end portion thereof; each corresponding slot of said first plurality of slots including a respective conductive clamp;

For each said corresponding slot of said first plurality of slots conductively connecting the conductive core of a respective wire of a first set of wires to said respective conductive clamp of said corresponding slot, and rotating a fastening ring over said first end portion of said rigid device body;

simultaneously attaching said first set of wires to said first end of said rigid device body as a result of said rotating; said simultaneously attaching including individually grasping the insulative sheath of each said respective wire of said first set of wires between said fastening ring and said corresponding slot of said each respective wire.

8. A method for electrically connecting according to claim 7, wherein said grasping of each said respective insulative sheath provides stress relief on a respective conductive core.

9. A method for electrically connecting according to claim 7, wherein each said respective conductive clamp is connected by a respective conductive bridge to a respective conductive clamp of a second plurality of conductive clamps in a second plurality of corresponding slots at a second end of the rigid device body.

10. A method for electrically connecting according to claim 7, wherein each said respective conductive clamp is operatively coupled to a depressible tab located on an exterior surface of said device body, the method further opening each said respective clamp by depressing a respective depressible tab.

11. The method of claim 10, further comprising:

blocking at least one said depressible tab as a result of said rotating said fastening ring.

12. The method of claim 7, wherein said device body includes a second plurality of slots at a second end portion of the device body each slot of said second plurality of slots including a respective conductive clamp further comprising:

inserting an end of a respective wire of a second set of conductive wires into each slot of said second plurality of slots at said second end portion;

rotationally fastening said second set of conductive wires simultaneously in said second plurality of slots, said rotationally fastening said first set of wire and said rotationally fastening said second set of wires causing mutual conductive attachment between said first and second sets of conductive wires connected.

13. A device for connecting wires having a conductive core and a insulative sheath comprising:

a device having a rigid body including a first end portion;

a plurality of slots including a first set of at least two slots in said first end portion;

a multiplicity of conductive clamps; a respective clamp of said multiplicity of conductive clamps disposed in each corresponding slot of said plurality of slots;

a first set of said wires; wherein a conductive core of at least one respective wire of said first set of said wires is conductively connected to said respective conductive clamp in each said corresponding slot of said first set of at least two slots;

a first fastening ring rotatable over said first end portion of said rigid body for simultaneously rotationally grasping an insulator of each said respective conductive wire of said first set of conductive wires between said fastening ring and said corresponding slot of said first set of slots in said rigid body.

14. A device according to claim 13, wherein each said respective conductive clamp comprises:

a bent conductive strip including a conductive bridge and an elongate section oriented at an acute angle directed upward from said conductive bridge, said elongate section bounded on one edge by a first plane;

an upper widened flat lip contiguous with said acutely angled elongate section, said lip extending across said first plane, an edge of said lip situated past said first plane on a side opposite said elongate section; said edge bounded by a second plane;

a downward oriented leg contiguous to said lip, said leg; and a slanted section extending upwards from said leg towards said bridge and lying between said first plane and said second plane, said slanted section terminating at a folded end section, said folded end section being capped by a depressible tab.

15. A device according to claim 14, wherein a gap is defined between said lip and said slanted section, said gap being widened so as to permit insertion of at least one said conductive core.

16. A device according to claim 13, wherein said rigid body comprises a unitary element when in use.

17. A device according to claim 13, wherein said rigid body comprises two interlocking elements wherein said first end portion is on a first of said two interlocking elements and said second is on a second of said two interlocking elements.

18. A device according to claim 13, wherein said rigid body comprises a multi junction element for mutually connecting a second set of conductive wires and a third set of conductive wires to said first set of conductive wires.

* * * * *